US010228207B2

(12) United States Patent
Novak

(10) Patent No.: US 10,228,207 B2
(45) Date of Patent: Mar. 12, 2019

(54) PISTOL INCLUDING MULTIFUNCTIONAL TRIGGER BAR, TRIGGER BAR RELEASE, DUAL SIDED TRIGGER BAR DEPRESSOR AND LOCKING BLOCK SPRINGS

(71) Applicant: Czech Small Arms, s.r.o., Jablunka (CZ)

(72) Inventor: Miroslav Novak, Modrice (CZ)

(73) Assignee: Czech Small Arms, s.r.o., Jablunka (CZ)

( * ) Notice: Subject to any disclaimer, the term of this patent is extended or adjusted under 35 U.S.C. 154(b) by 0 days.

(21) Appl. No.: 15/910,044

(22) Filed: Mar. 2, 2018

(65) Prior Publication Data

US 2018/0259284 A1 Sep. 13, 2018

Related U.S. Application Data

(60) Provisional application No. 62/465,999, filed on Mar. 2, 2017.

(51) Int. Cl.

| | |
|---|---|
| ***F41A 19/31*** | (2006.01) |
| ***F41A 17/64*** | (2006.01) |
| ***F41A 17/72*** | (2006.01) |
| ***F41A 19/32*** | (2006.01) |

(52) U.S. Cl.

CPC ..... *F41A 19/31* (2013.01); *F41A 17/64* (2013.01); *F41A 17/72* (2013.01); *F41A 19/32* (2013.01)

(58) Field of Classification Search

CPC ..... F41A 19/31

See application file for complete search history.

(56) References Cited

U.S. PATENT DOCUMENTS

| | | | | |
|---|---|---|---|---|
| 6,308,448 | B1 | 10/2001 | Kapusta | |
| 6,354,032 | B1 * | 3/2002 | Viani | F41A 19/10 42/42.03 |
| 7,690,144 | B2 * | 4/2010 | Fagundes de Campos | F41A 17/72 42/69.02 |
| 2005/0011098 | A1 * | 1/2005 | Fagundes de Campos | F41A 17/72 42/70.04 |
| 2013/0000173 | A1 | 1/2013 | Green | |
| 2016/0320155 | A1 | 11/2016 | Singh | |

FOREIGN PATENT DOCUMENTS

| | | |
|---|---|---|
| WO | 2006000851 | 1/2006 |

OTHER PUBLICATIONS

Invitation to Pay Additional Fees including references cited form International Search (dated May 25, 2018).

Written Opinion of the International Searching Authority (dated Jul. 18, 2018).

International Search Report and Written Opinion of the International Searching Authority (dated Jul. 18, 2018).

* cited by examiner

*Primary Examiner* — Reginald S Tillman, Jr.

(74) *Attorney, Agent, or Firm* — Robinson IP Law, PLLC

(57) ABSTRACT

A pistol including a multifunctional trigger bar, trigger bar release, trigger bar depressor including two configurations, and a locking block cushioned by locking block springs.

4 Claims, 25 Drawing Sheets

PISTOL INCLUDING MULTIFUNCTIONAL TRIGGER BAR, TRIGGER BAR RELEASE, DUAL SIDED TRIGGER BAR DEPRESSOR AND LOCKING BLOCK SPRINGS

CROSS-REFERENCE(S) TO RELATED APPLICATION(S)

This application claims priority to U.S. Provisional Patent Application Ser. No. 62/465,999 entitled "Pistol Including Multifunctional Trigger Bar and Trigger Bar Release" by Miroslav Novak which was filed on Mar. 2, 2017, the content of which is incorporated herein by reference in its entirety.

FIELD

This disclosure relates to the field of firearms. More particularly, this disclosure relates to an improved pistol, trigger bar and trigger bar release mechanism.

BACKGROUND

For well over 200 years, pistol technology has evolved with improvements to pistol design including various safety features. When possible, the number of parts required for a given function of a pistol are minimized, so when a single part can perform multiple functions in pistol design, such design is preferred. This is particularly helpful when some of those features are related to safety and relate to the firing of a pistol—a function primarily linked with trigger action including a trigger bar.

One common danger with pistols is the process of removing a pistol slide (top portion of the pistol) from a pistol base. When separating these parts of a pistol, it is often necessary for a user to pull the trigger to release a striker in the pistol. This can be particularly dangerous because it can cause the pistol to be inadvertently fired when taking a pistol apart.

Another danger with pistols is the trigger action (i.e., how much force is needed to pull the trigger and fire the pistol). Different pistols have different levels of trigger action so different shooters are accustomed to different levels of trigger action. As such, someone accustomed to a pistol with stronger trigger action might be more likely to accidentally fire a pistol with a very light trigger action. Providing a pistol with different levels of trigger action minimizes this problem while allowing for both a light and stronger trigger action if the user desires to change the trigger action or if a different user prefers a different trigger action.

Virtually all pistols have a locking and unlocking block, pins or other similar devices that help to lock and unlock the barrel. No such devices include springs connected to the locking block, however. The lighter a pistol is, the harder the recoil to the hand of a user. Making a pistol heavier helps address this problem, but it is often advantageous to have a lighter pistol for other reasons. As such, what is needed is a novel way to minimize the recoil of a pistol—particularly for light pistols.

What is needed therefore is a pistol with a trigger bar that performs multiple tasks. What is also needed is a pistol in which a pistol slide can be removed from a pistol base without the need of pulling the trigger of the pistol. Another need is the ability for a single pistol to provide more than one option regarding the strength of the trigger action of the pistol. Another need is a way to soften the recoil in a pistol even when such pistol is a light weight pistol.

SUMMARY

The above and other needs are met by a pistol comprising a multifunctional trigger bar, a trigger bar release mechanism, and/or a trigger bar depressor having multiple configurations. In one embodiment the pistol comprises a pistol base and a pistol slide physically engaged with the pistol base wherein the pistol slide slides relative to the pistol base during firing of the pistol. The pistol base further includes (a) a base frame; (b) a trigger connected to the base frame; (c) a trigger bar connected to the trigger proximate to a first end of the trigger bar; and (d) a trigger bar depressor inserted in the base frame. The trigger bar further includes (i) a primary arm that extends from the first end of the trigger bar to a second end of the trigger bar; (ii) a first trigger bar extension extending out from a first side of the primary arm; (iii) a second trigger bar extension extending out from a second side of the primary arm; and (iv) a third trigger bar extension extending out from the first side of the trigger arm and further comprising a first sub-extension extending upward toward a pistol slide. The trigger bar depressor further includes a first depressor extension wherein an upper edge of the trigger bar contacts and slides partially underneath the first depressor extension when the trigger is pulled wherein the contact with the first depressor extension forces the trigger bar away from the pistol slide to place the trigger bar in a depressed state.

The pistol slide further includes a striker, a striker safety extension, and a first slide ridge. The striker further comprises a striker plunger assembly including a spring for biasing the striker in a first direction relative to the pistol base; and a striker extension extending downward and in direct contact with the first sub-extension of the trigger bar wherein the first sub-extension of the trigger bar retains the striker until the trigger is pulled by a user at which point the trigger bar moves to the depressed state, the striker extension is released from the first sub-extension of the trigger bar and the striker is propelled in the first direction by the striker plunger assembly. The striker safety extension extends toward the pistol base from the pistol slide and physically engages with the striker to prevent the striker from moving in the first direction. The striker safety extension is contacted by the first trigger bar extension when the trigger is pulled wherein such contact moves the striker safety extension, disengaging the striker safety extension from the striker and thereby allowing the striker to be propelled in the first direction by the striker plunger assembly. The first slide ridge is located along an interior surface of the pistol slide along a first side of the pistol slide wherein the first slide ridge contacts the second trigger bar extension when the pistol slide moves forward relative to the pistol base after the pistol slide has recoiled after the pistol has been fired wherein such contact between the first slide ridge and second trigger bar extension forces the trigger bar up out of the depressed state to reengage the first sub-extension with the striker extension.

In one embodiment, the pistol described above further comprises (a) trigger bar release member groove in the pistol base proximate to a rear end of the pistol base; (b) a trigger bar release member inserted into the trigger bar release member groove; (c) the pistol slide further comprising a second slide ridge proximate to a rear end of the pistol slide oriented so that the second slide ridge presses down on an upper edge of the trigger bar release member when the pistol slide is pushed forward relative to the pistol base; and the third trigger bar extension further comprising a second sub-extension that is forced away from the pistol slide as the second sub-extension is contacted by a lower edge of the trigger bar release member when the pistol slide is slid forward relative to the pistol base, thereby forcing the trigger bar into the depressed state and freeing the striker extension from the first sub-extension so that the pistol slide can be completely disengaged from the pistol base without pulling the trigger.

In one embodiment, the pistol described above further comprises (a) the trigger bar depressor further comprising (i) a trigger bar depressor base; (ii) a first trigger bar depressor arm; and (iii) a second trigger bar depressor arm wherein the first trigger bar depressor arm and the second trigger bar depressor arm extend from the trigger bar depressor base in a substantially symmetrical configuration, wherein the first trigger bar depressor arm includes the first depressor extension oriented at a first angle, and wherein the second trigger bar depressor arm includes a second depressor extension oriented at a second angle. The pistol further comprises (b) a plurality of trigger bar depressor grooves in the base frame in which the trigger bar depressor is housed and is held substantially stationary relative to the base frame, wherein the trigger bar depressor can be inserted into the plurality of trigger bar depressor grooves in two different configurations including a first configuration in which the upper edge of the trigger bar contacts and slides partially underneath the first depressor extension when the trigger is pulled resulting in a first trigger pull weight and a second configuration in which the upper edge of the trigger bar contacts and slides partially underneath the second depressor extension when the trigger is pulled resulting in a second trigger pull weight.

In one embodiment, a pistol is disclosed comprising (a) a trigger bar depressor comprising (i) a trigger bar depressor base; (ii) a first trigger bar depressor arm including a first depressor extension oriented at a first angle from a first end of the first trigger bar depressor arm; and (iii) a second trigger bar depressor arm including a second depressor extension oriented at a second angle from a first end of the second trigger bar depressor arm, wherein the first trigger bar depressor arm and the second trigger bar depressor arm extend from the trigger bar depressor base in a substantially symmetrical configuration.

The pistol may further include (b) a pistol slide physically engaged with a pistol base wherein the pistol slide slides relative to the pistol base during firing of the pistol; (c) a pistol base comprising (i) a base frame; (ii) a trigger connected to the base frame; (iii) a trigger bar connected to the trigger proximate to a first end of the trigger bar, the trigger bar further comprising a primary arm that extends from the first end of the trigger bar to a second end of the trigger bar; (iv) the trigger bar depressor inserted in the base frame into trigger bar depressor grooves where the trigger bar depressor is held substantially stationary relative to the base frame, wherein the trigger bar depressor can be inserted into the trigger bar depressor grooves in two different configurations including a first configuration in which the upper edge of the trigger bar contacts and slides partially underneath the first depressor extension when the trigger is pulled resulting in a first trigger pull weight and a second configuration in which the upper edge of the trigger bar contacts and slides partially underneath the second depressor extension when the trigger is pulled resulting in a second trigger pull weight.

In another embodiment, a pistol is disclosed comprising (a) a pistol base and (b) a pistol slide physically engaged with the pistol base wherein the pistol slide slides relative to the pistol base during firing of the pistol. The pistol base further comprises (i) a base frame; (ii) a trigger connected to the base frame; (iii) a trigger bar connected to the trigger proximate to a first end of the trigger bar; (iv) a trigger bar release member groove in the pistol base proximate to a rear end of the pistol base; and (v) the trigger bar release member inserted into the trigger bar release member groove. The trigger bar further comprises (1) a primary arm that extends from the first end of the trigger bar to a second end of the trigger bar; and (2) a trigger bar extension extending out from a first side of the trigger arm. The trigger bar extension further comprises (a) first sub-extension extending upward toward a pistol slide; and (b) a second sub-extension extending out beneath a trigger bar release member.

The pistol slide further comprises (i) a striker and (ii) a second slide ridge. The striker further comprises (1) a striker plunger assembly including a spring for biasing the striker in a first direction relative to the pistol base; and (2) a striker extension extending downward and in direct contact with the first sub-extension of the trigger bar wherein the first sub-extension of the trigger bar retains the striker until the trigger is pulled by a user at which point the trigger bar moves to a depressed state, the striker extension is released from the first sub-extension of the trigger bar and the striker is propelled in the first direction by the striker plunger assembly. The second slide ridge is located proximate to a rear end of the pistol slide oriented so that the second slide ridge presses down on an upper edge of the trigger bar release member when the pistol slide is pushed forward relative to the pistol base and wherein the second sub-extension is forced away from the pistol slide as the second sub-extension is contacted by a lower edge of the trigger bar release member when the pistol slide is pushed forward relative to the pistol base, thereby forcing the trigger bar into the depressed state and freeing the striker extension from the first sub-extension so that the pistol slide can be completely disengaged from the pistol base without pulling the trigger.

In one embodiment, a pistol is disclosed comprising a pistol base, a pistol slide, and a pistol barrel which can be locked and unlocked with the pistol slide during firing by a locking block which is connected to the pistol base, preferably via a hinge joint including an aperture extending through the bottom of the locking block and a rod extending through the aperture. The rod further extends out each side of the aperture into the pistol base to connect the locking block to the pistol base. A pair of locking block springs extend into a pair of recesses inside the locking block wherein the springs partially extend out from the locking block and separate at least a part of the locking block from an interior surface of the pistol base.

More specifically, a pistol is disclosed including a pistol base and a pistol slide slidably engaged with the pistol base and a barrel resting in the pistol slide and selectively engaged with the pistol slide. The pistol base comprises (i) a pistol base frame comprising an internal surface; (ii) a locking block connected to the pistol base frame wherein the locking block is free to partially rotate along a rod connected to the pistol base frame, the locking block further comprising (1) an aperture through which the rod extends; and (2) a plurality of recesses facing the internal surface of the pistol base frame; and (iii) a plurality of springs wherein a separate spring is located in each of the plurality of recesses in the locking block, wherein the plurality of springs partially extend out of the plurality of recesses and wherein distal ends of the plurality of springs are in contact with the internal surface of the pistol base frame so that the plurality of springs cushion the impact of the locking block against the pistol base frame when the pistol is fired causing the barrel to slam against the locking block.

The summary provided herein is intended to provide examples of particular disclosed embodiments and is not intended to cover all potential embodiments or combinations of embodiments. Therefore, this summary is not intended to limit the scope of the invention disclosure in any way, a function which is reserved for the appended claims.

BRIEF DESCRIPTION OF THE DRAWINGS

Further features, aspects, and advantages of the present disclosure will become better understood by reference to the following detailed description, appended claims, and accompanying figures, wherein (with the exception of FIG. 5 which is drawn to scale) elements are not to scale so as to more clearly show the details, wherein like reference numbers indicate like elements throughout the several views, and wherein:

The figures are provided to illustrate concepts of the invention disclosure and are not intended to embody all potential embodiments of the invention. Therefore, the figures are not intended to limit the scope of the invention disclosure in any way, a function which is reserved for the appended claims.

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
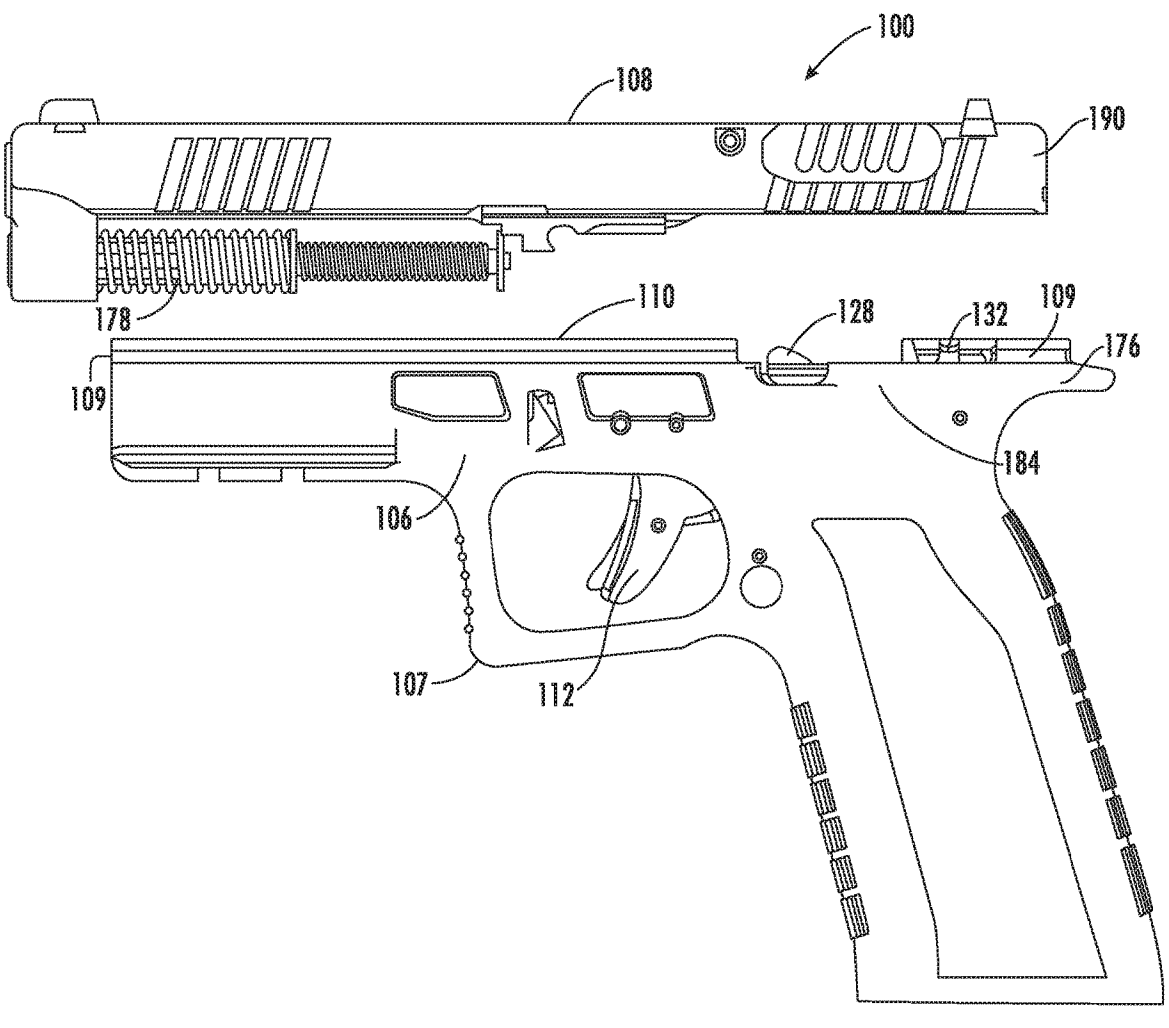
FIG. 1 shows an image of a pistol disassembled into two parts including a pistol base and a pistol slide cover.
Figure 2:
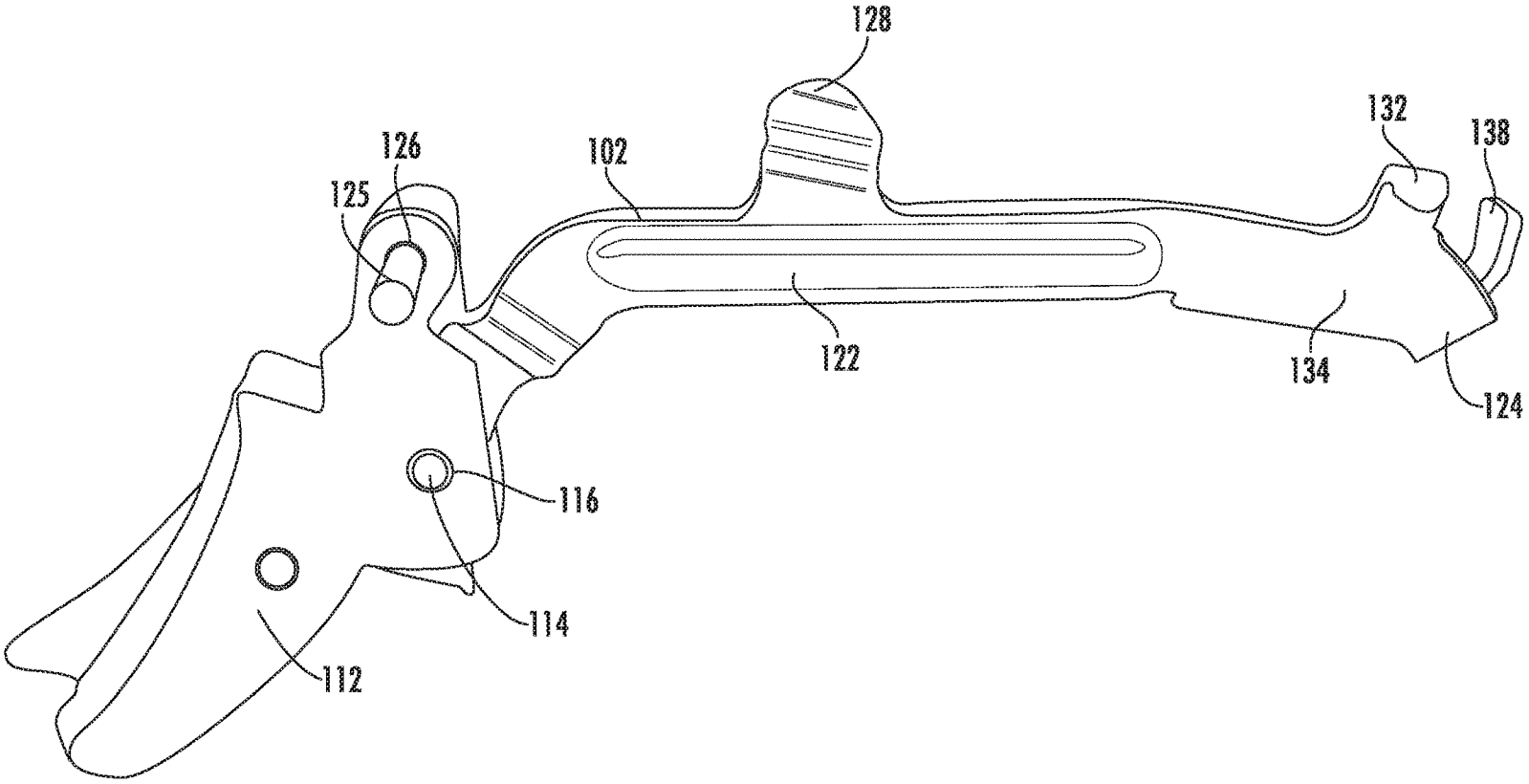
FIG. 2 shows a first side view of a trigger bar and a trigger attached thereto for use with a striker fired pistol such as the pistol shown in FIG. 1.
Figure 3:
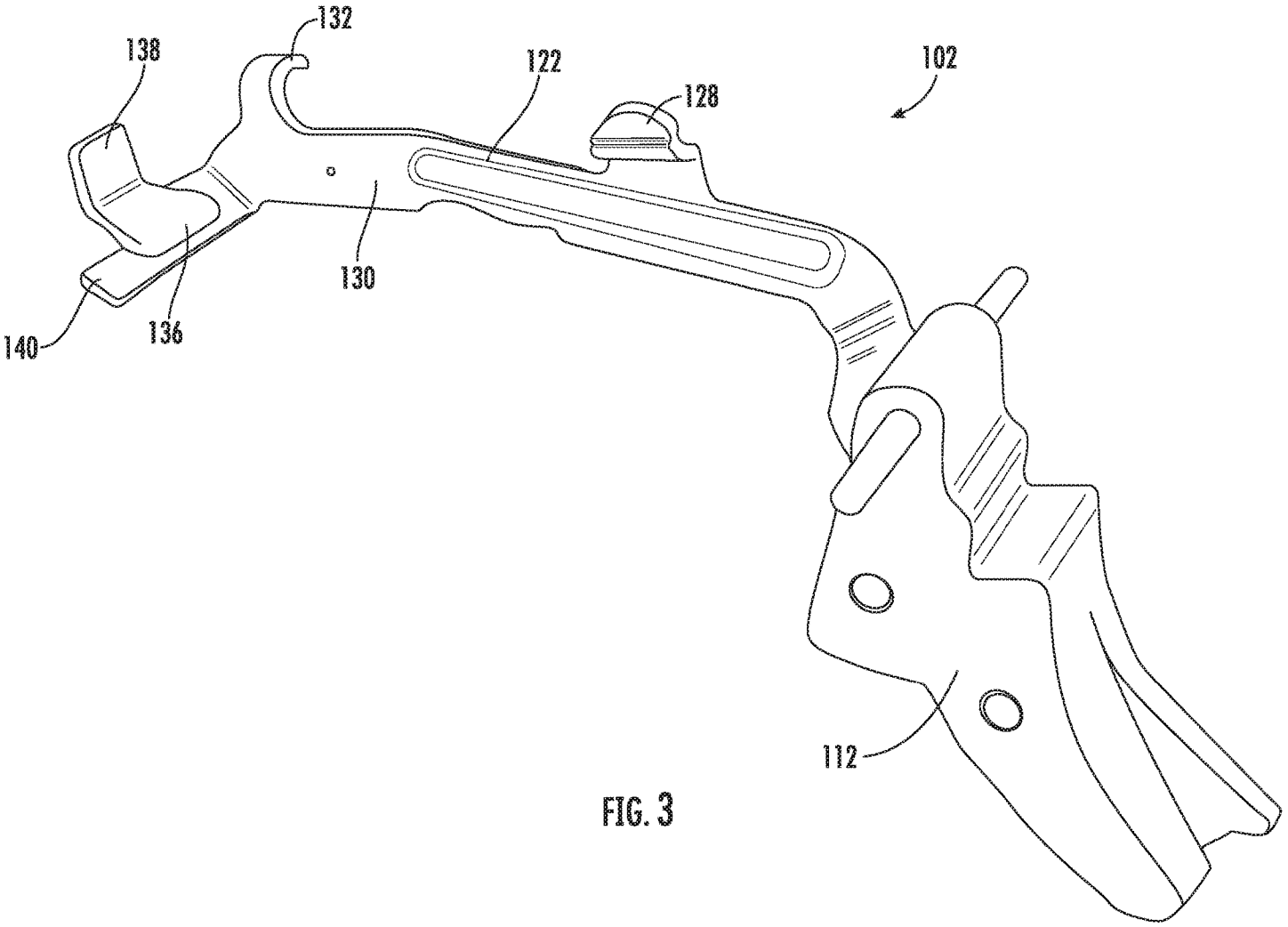
FIG. 3 shows a second side view of the trigger bar and trigger from FIG. 2.
Figure 4:
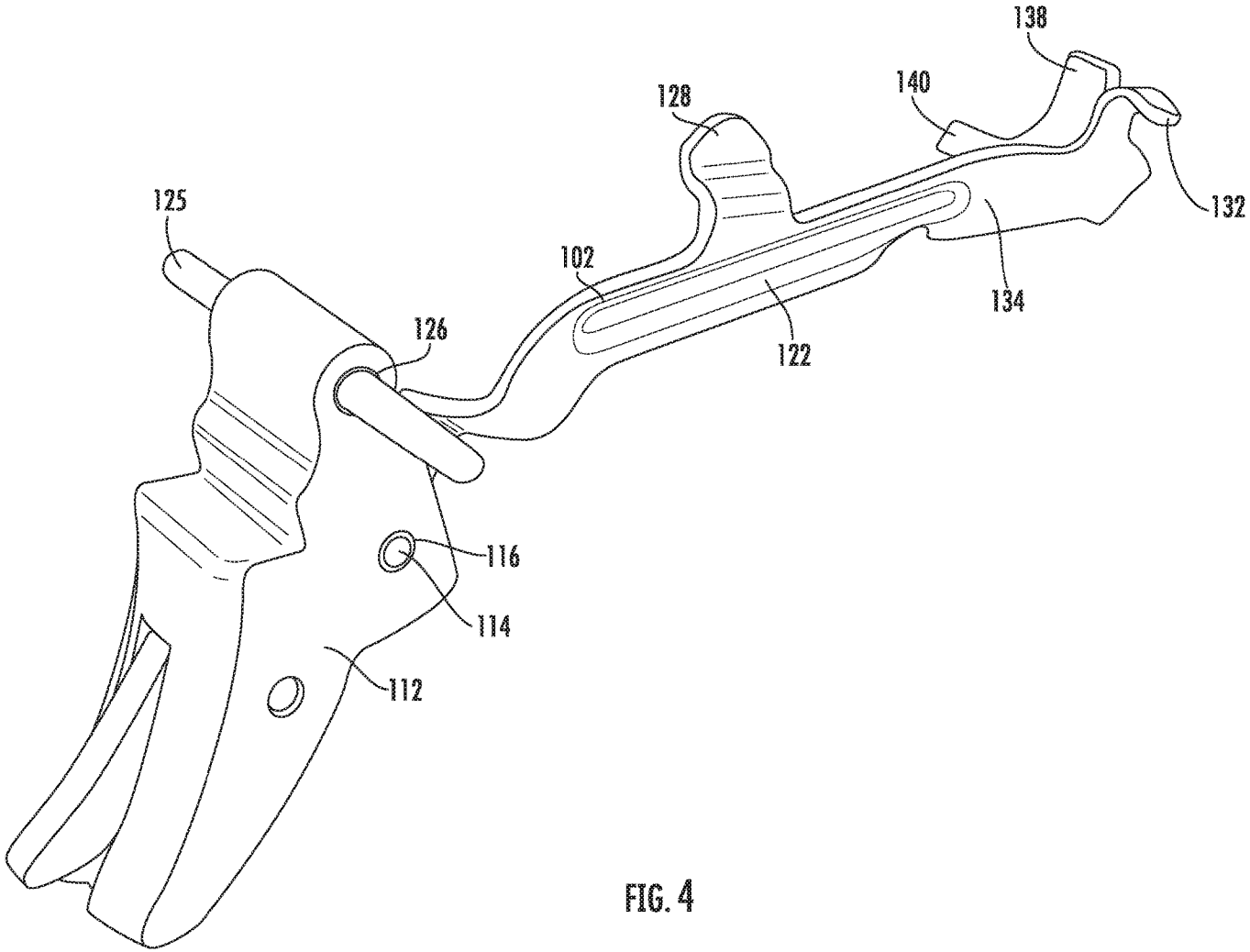
FIG. 4 shows a perspective view of the trigger bar and trigger from FIG. 2 and FIG. 3.

A pistol 100 including a multifunctional trigger bar 102 is disclosed. FIG. 1 shows two primary parts of the pistol 100 including a pistol base 106 (including a pistol base frame 107) and a pistol slide 108 (or "pistol slide cover") configured to move and slide along grooves 109 in a top portion 110 of the pistol base 106 wherein the grooves 109 are used to guide ridges 111 in the pistol slide 108 for relative movement between the pistol base 106 and the pistol slide 108. The pistol 100 shown is a double action pistol.

The multifunctional trigger bar 102 is shown in FIGS. 2-5 which shows the trigger bar 102 and a trigger 112 connected to the trigger bar 102, preferably via a hinge joint including a first trigger rod 114 extending through a first trigger aperture 116 and through a trigger bar aperture 118 near a first end 120 of the trigger bar 102. The trigger bar 102 includes a primary arm 122 that extends from the first end 120 of the trigger bar 102 at or near the trigger 112 to a second end 124 of the trigger bar 102. The trigger bar 102 is connected to the pistol base frame 107 preferably by a hinge joint including a second trigger rod 125 extending through a second trigger aperture 126 in the trigger 112 and into the pistol base frame 107.

Figure 5:
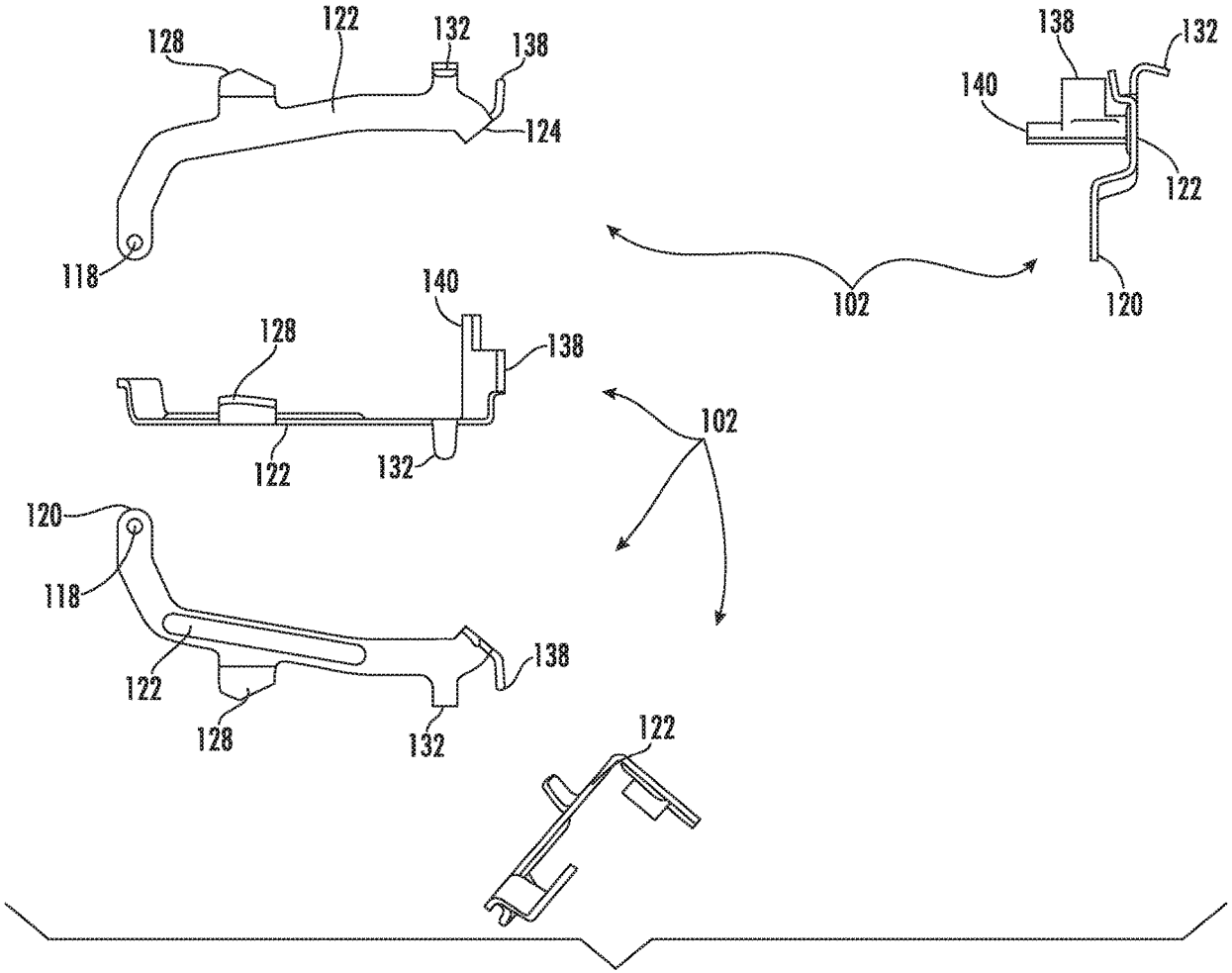
FIG. 5 shows multiple to scale views of the trigger bar from FIGS. 1-4.

The trigger bar 102 is shown by itself in FIG. 5 in different angular views wherein specific relative angles of physical features of the trigger bar 102 are shown to scale. With reference to FIGS. 2-5, one of those features includes a first trigger bar extension 128 that extends preferably out from a first side 130 of the primary arm 122 and up from the primary arm 122. Another feature includes a second trigger bar extension 132 that extends preferably up and out from a second side 134 the primary arm 122. Yet another feature is a third trigger bar extension 136 that extends preferably out from the first side 130 of the primary arm 122. The third trigger bar extension 136 includes a first sub-extension 138 and a second sub-extension 140 that are preferably oriented substantially perpendicular to one another.

Figure 6:
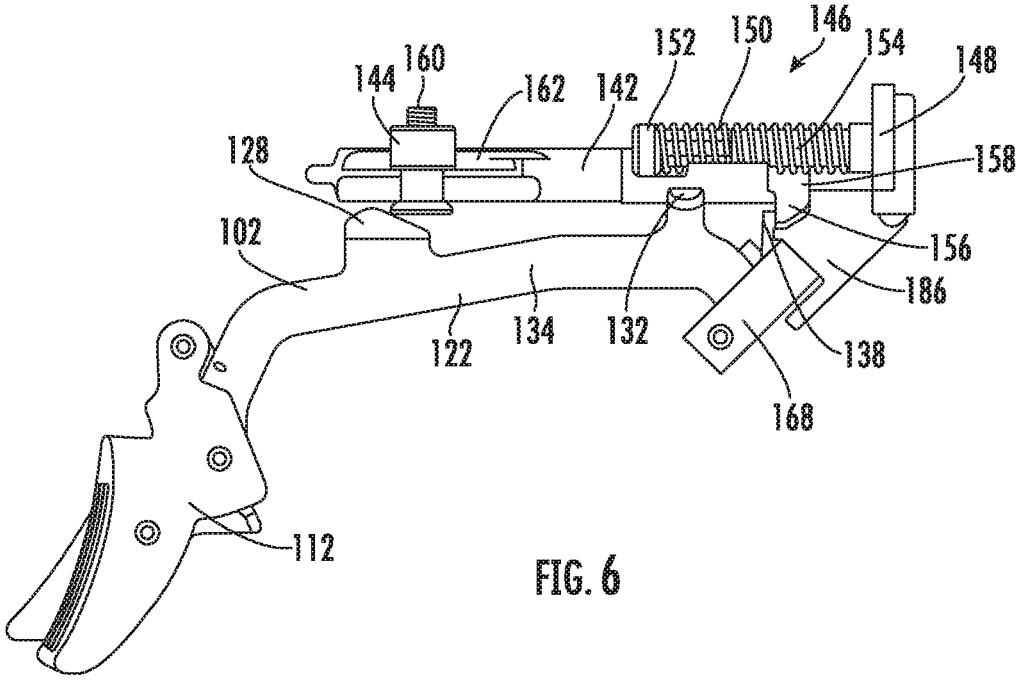
FIG. 6 shows a schematic of certain internal components of a pistol including the trigger bar and trigger from FIGS. 1-4 plus a striker, a striker safety extension, a striker plunger assembly, a trigger bar depressor and trigger bar release member.

FIGS. 6, 7, 9 and 11 show the trigger bar 102 engaging with features of the pistol slide 108 including a striker 142, a striker safety extension 144, a striker plunger assembly 146 and a pistol slide back plate 148. The striker plunger assembly 146 preferably includes a striker spring 150, a first plunger part 152 and a second plunger part 154 wherein a portion of the first plunger part 152 reciprocates inside a portion of the second plunger part during operation of the pistol 100. FIG. 6 shows parts of the pistol 100 in a retaining position wherein the first sub-extension 138 of the third trigger bar extension 136 operates as a striker catch engaging with a striker extension 156 along a rear end 158 of the striker 142 to retain the striker 142.

Figure 7:
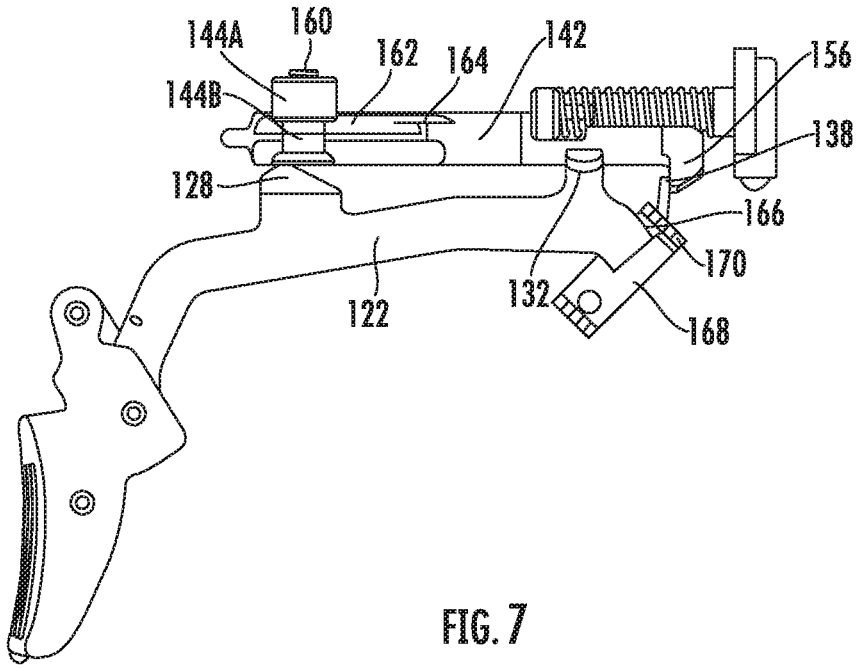
FIG. 7 shows a schematic of the components from FIG. 6 wherein the trigger has been depressed at least partially, engaging the trigger bar with the striker safety extension and engaging the trigger bar with the trigger bar depressor as the striker is moved to a more cocked position.

FIG. 7 shows parts of the pistol 100 in a cocked or partially cocked position wherein the first trigger bar extension 128 presses against the striker safety extension 144 which is preferably under tension via a striker safety extension spring 160. The striker safety extension 144 is housed in and extends down from the pistol slide 108 as shown, for example, in FIG. 16 and FIG. 17. The safety extension 144 preferably includes a broad portion 144A and a narrow portion 144B. The striker 142 includes a safety groove 162 including a safety groove edge 164 that prevents the striker 142 from fully firing when the broad portion 144A of the striker safety extension 144 remains in the way of the safety groove edge 164. However, when the trigger is pulled causing the first trigger bar extension 128 to press against the striker safety extension 144, the narrow portion 144B of the striker safety extension 144 moves up in line with the safety grove edge 164, allowing more room for the striker 142 to move forward when fired so that the striker 142 fully contacts a bullet when the pistol 100 is fired.

Figure 8:
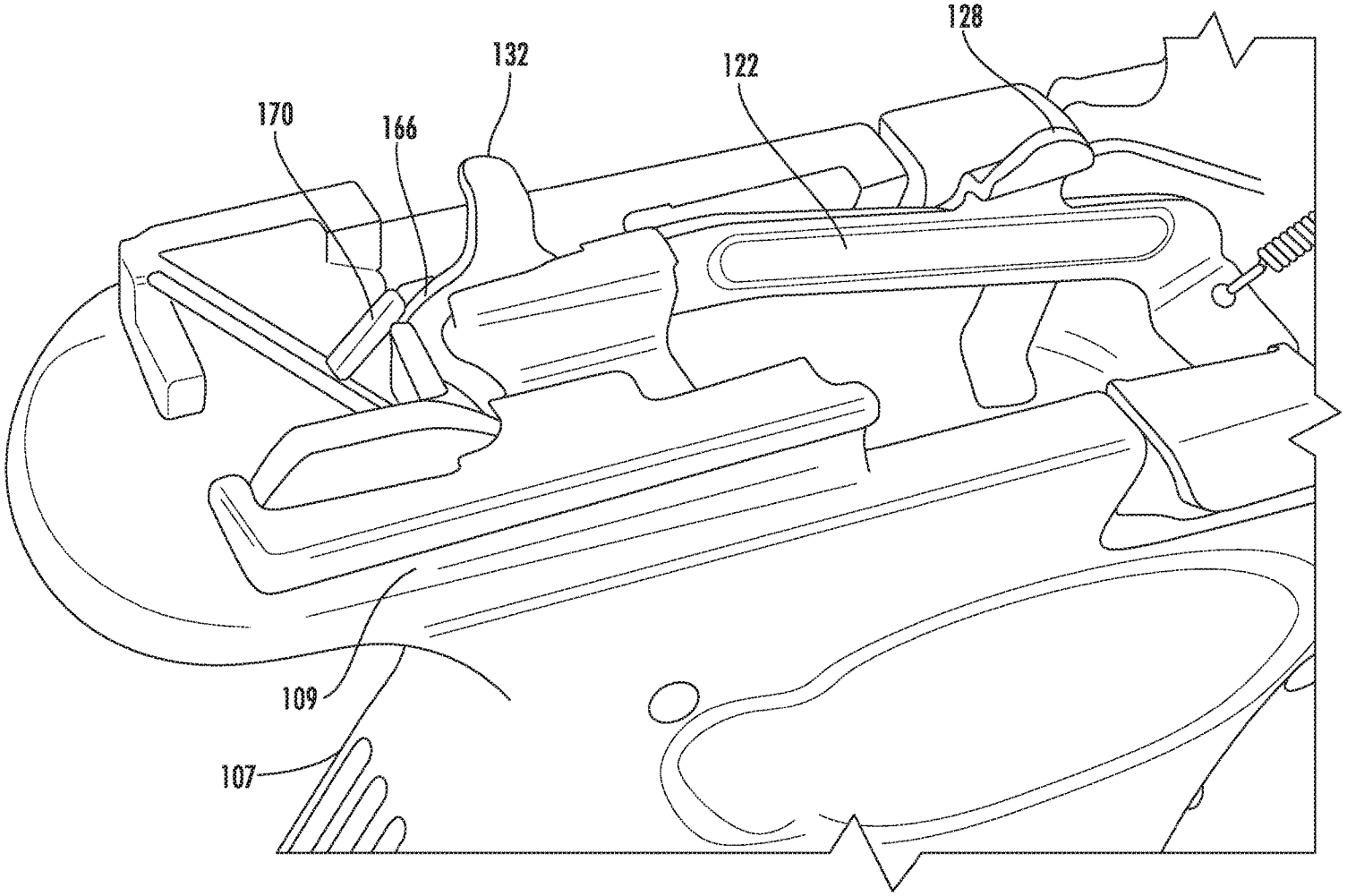
FIG. 8 shows a perspective image of a rear end of a pistol base showing the trigger bar engaging with the trigger bar depressor.
Figure 9:
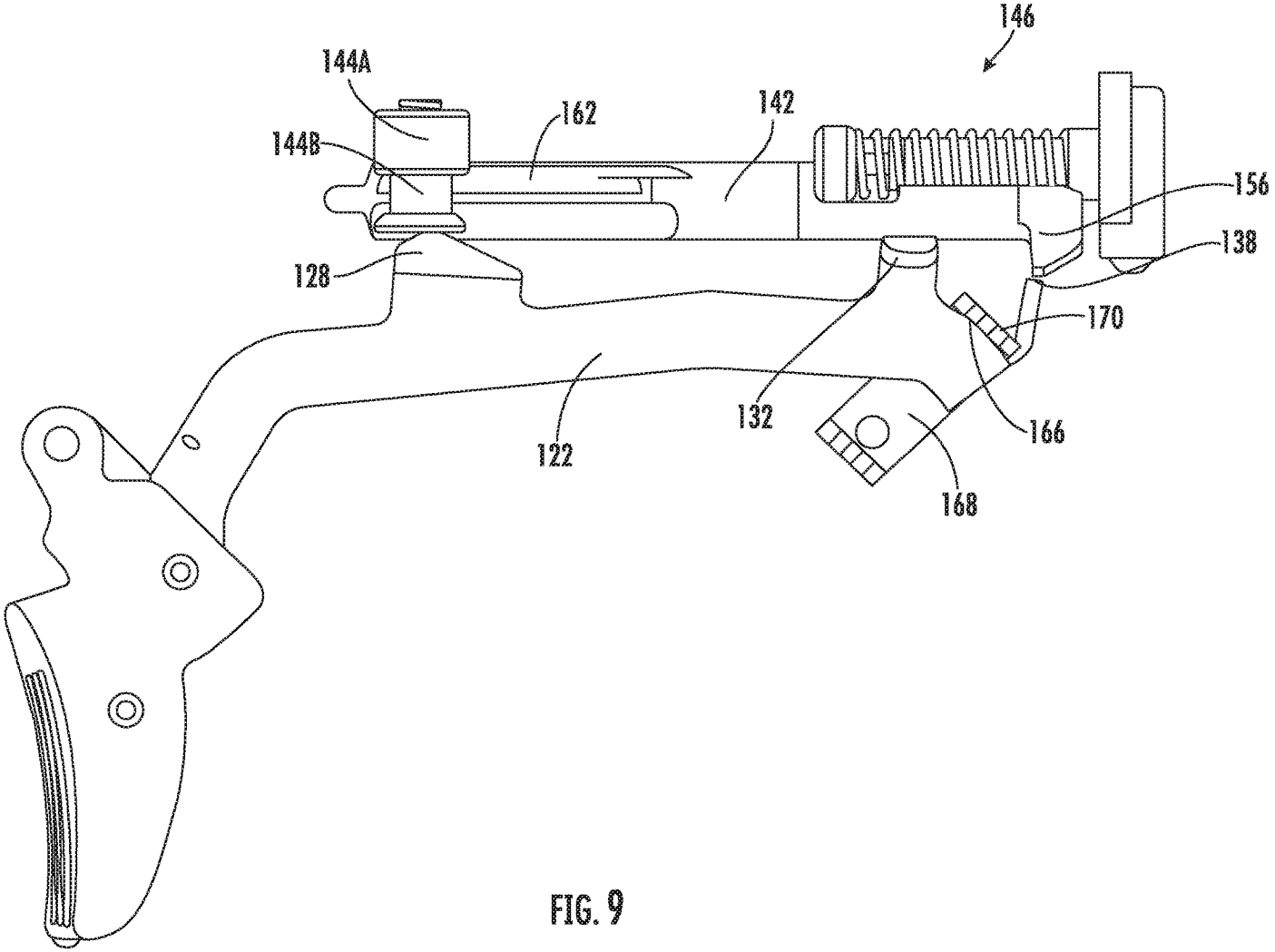
FIG. 9 shows a schematic of the components from FIG. 6 and FIG. 7 at the point in time when the trigger bar disengages from the striker, releasing the striker to be pushed forward by the striker plunger assembly.
Figure 10:
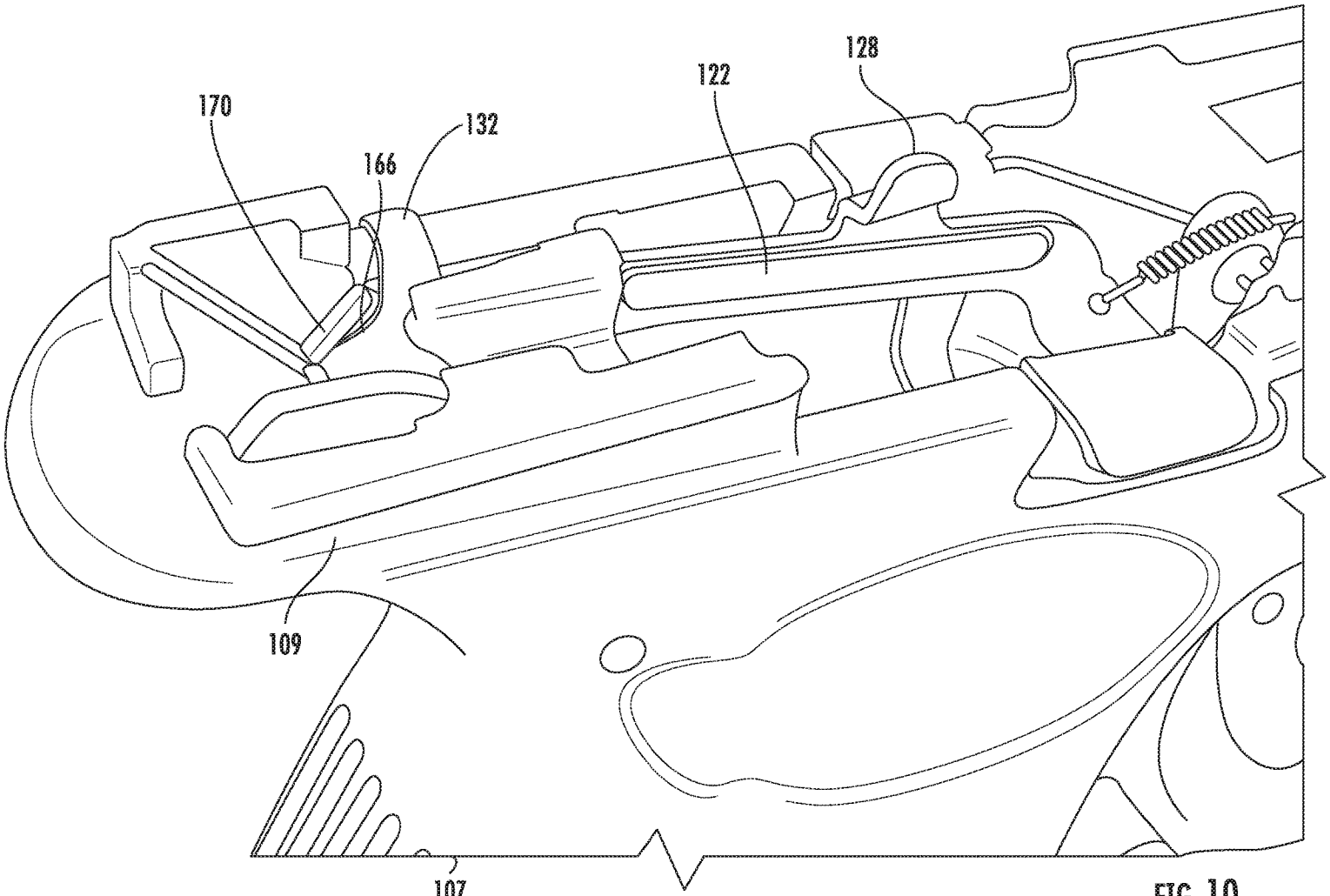
FIG. 10 shows another perspective image of the rear end of the pistol from FIG. 8 further showing the trigger bar in a depressed position beneath the trigger bar depressor.
Figure 14:
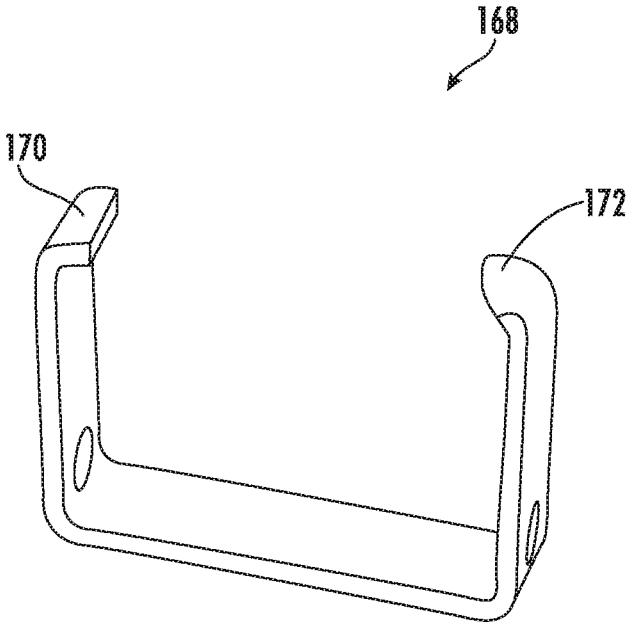
FIG. 14 shows a first image of a trigger bar depressor.
Figure 15:
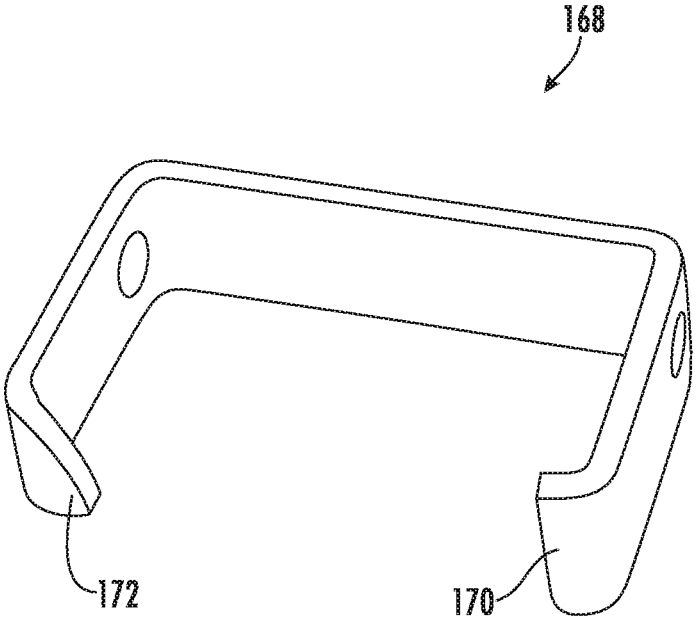
FIG. 15 shows a second image of a trigger bar depressor.

As the trigger bar 102 moves rearward when the trigger 112 is being depressed, a rear upper edge 166 of the primary arm 122 engages with a trigger bar depressor 168 (shown by itself in FIG. 14 and FIG. 15). The trigger bar depressor 168 includes a first depressor extension 170 oriented at a first angle under which the rear upper edge 166 of the primary arm 122 slides. FIG. 6 shows how the trigger bar depressor looks from the side and FIG. 7 shows a cutaway view of the near side of the trigger bar depressor revealing the near side first depressor extension 170 of the trigger bar depressor 168 and showing how the rear upper edge 166 of the primary arm 122 rubs against and is forced downward by the first depressor extension 170. FIG. 8 shows an image showing the rear upper edge 166 of the primary arm 122 beginning to slide against and underneath the first depressor extension 170. FIG. 9 and FIG. 10 show the trigger bar 102 in a fully depressed state and FIG. 9 shows the moment when the first sub-extension 138 of the third trigger bar extension 136 releases the striker extension 156, thereby releasing the striker 142 to be propelled forward by the striker plunger assembly 146.

Figure 11:
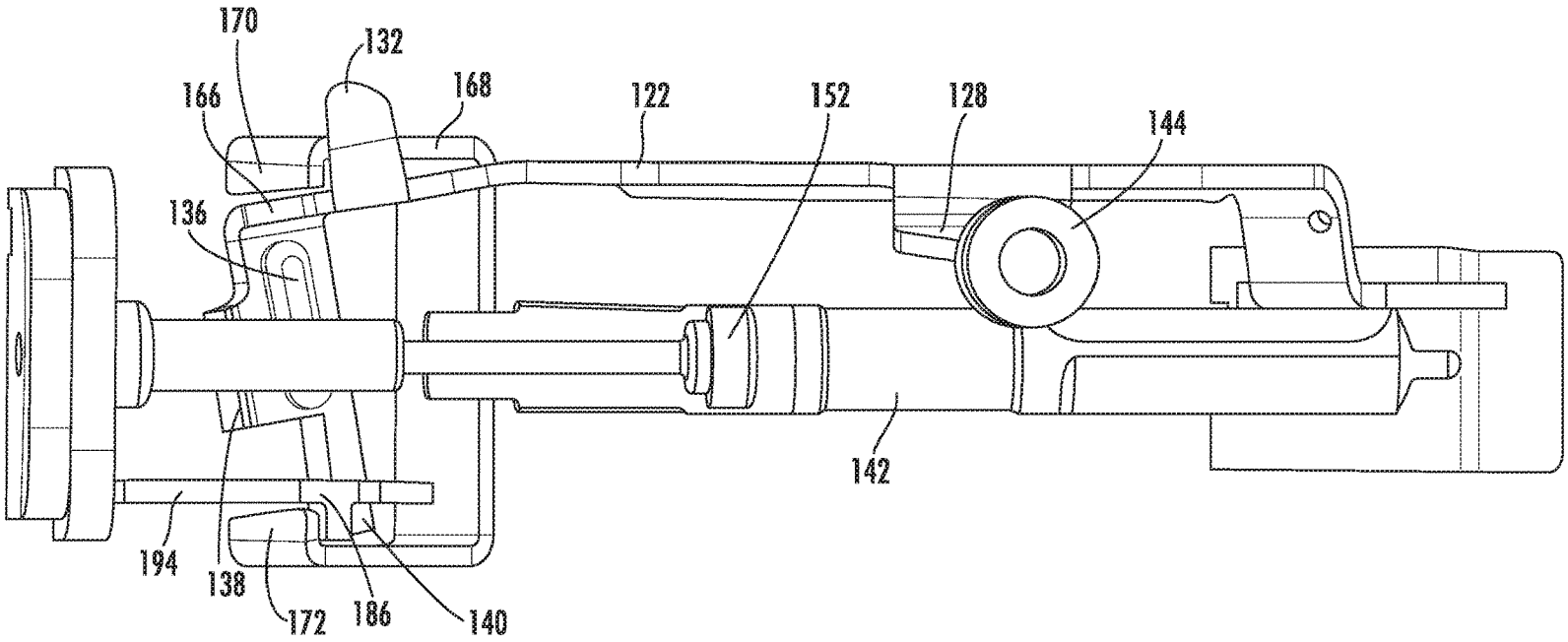
FIG. 11 shows a top view of the internal components of the pistol from FIG. 6, FIG. 7 and FIG. 9 after a shot has been fired and after the trigger bar has been pushed out from underneath a trigger bar depressor.
Figure 12:
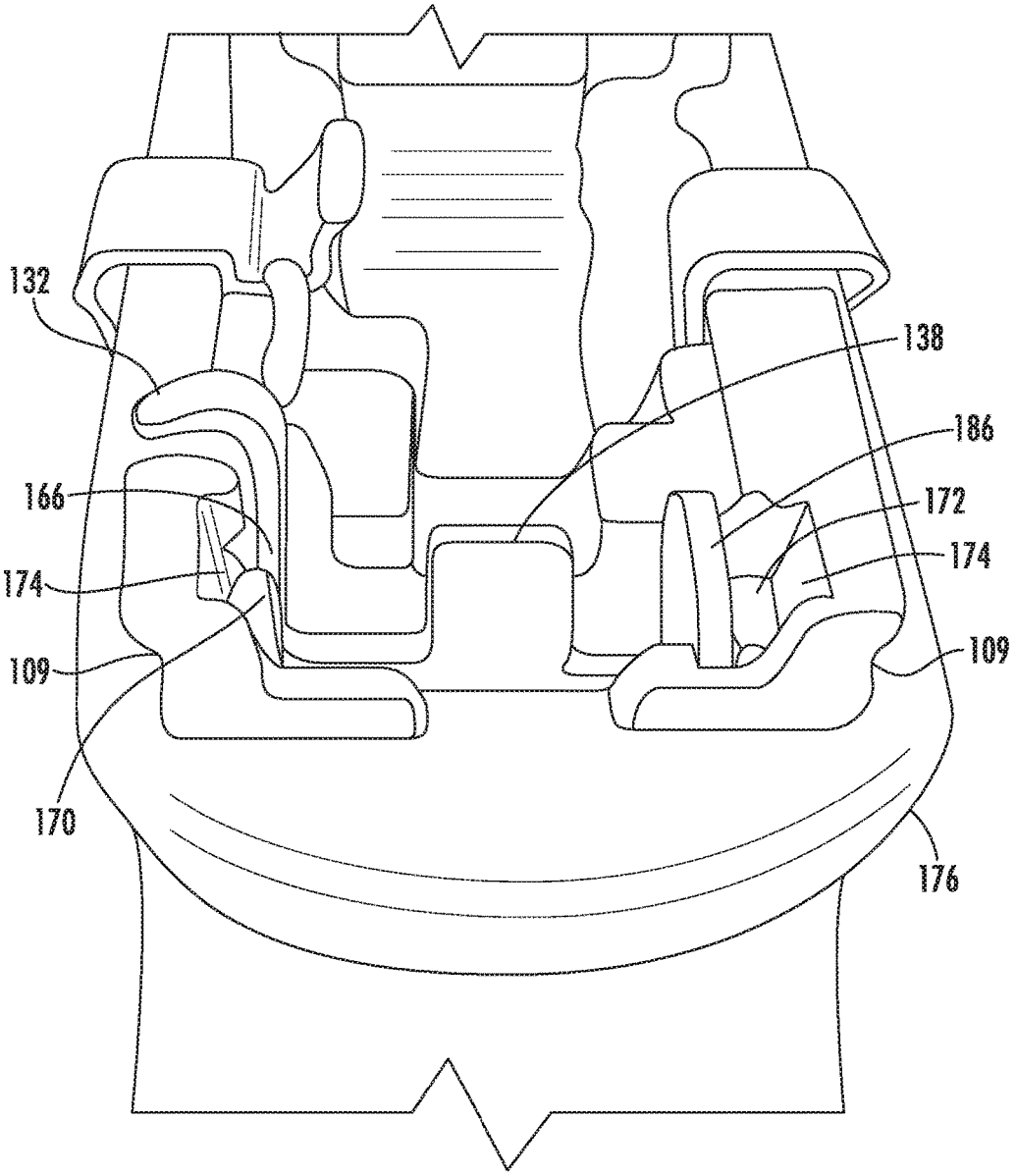
FIG. 12 shows an image of the rear end of the pistol from FIG. 8 and FIG. 10.
Figure 13:
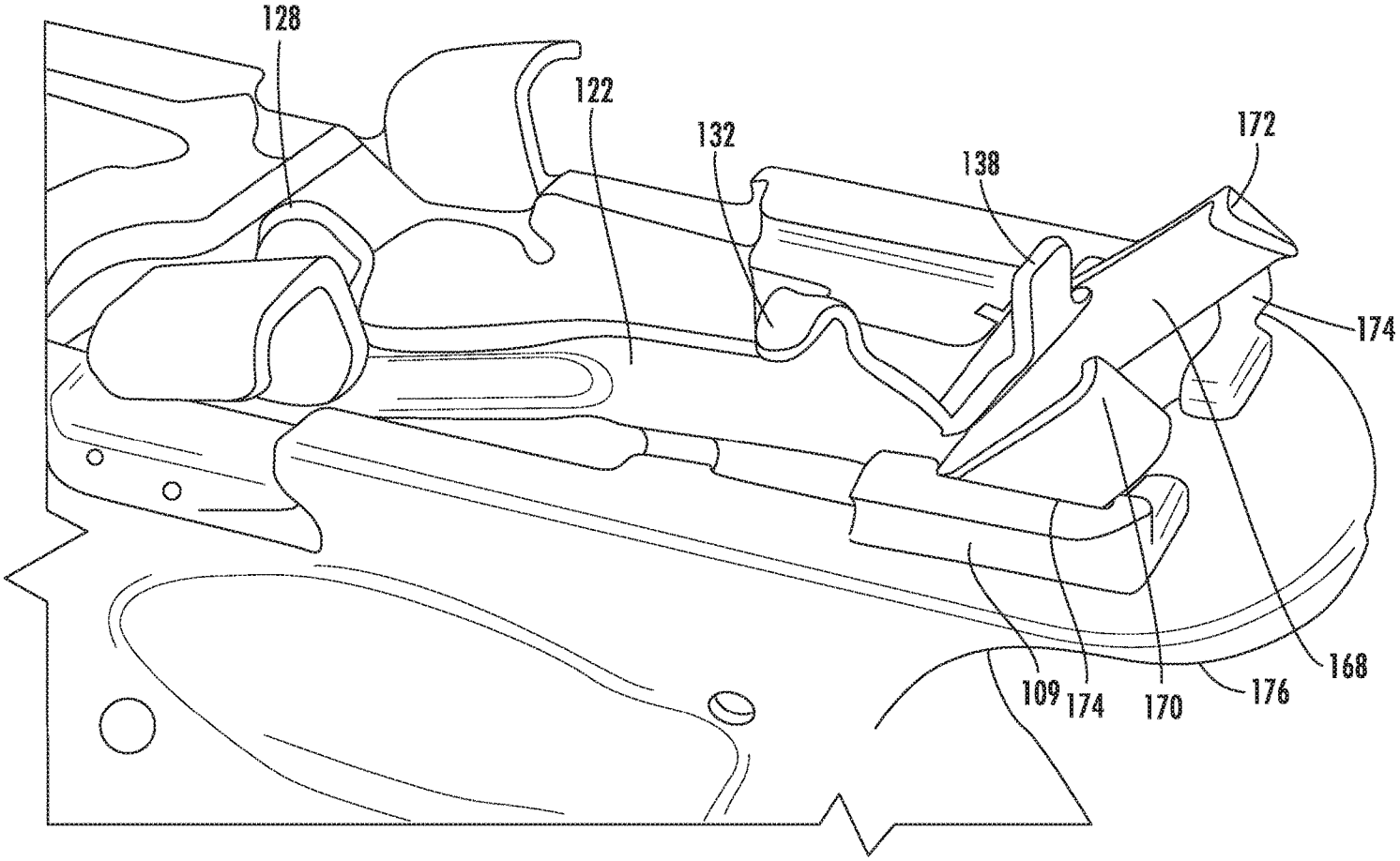
FIG. 13 shows a different perspective view of the rear end of the pistol from FIG. 8, FIG. 10 and FIG. 12 wherein the trigger bar depressor is partially inserted into trigger bar depressor grooves in the pistol base.

FIG. 11 shows a view looking down on the component parts from FIGS. 6, 7 and 9 wherein the striker 142 has been propelled forward to strike a bullet in a chamber of the pistol 100. A clear view of the trigger bar depressor 168 including the first depressor extension 170 and a second depressor extension 172 oriented at a second angle is shown in FIG. 11, and views of the trigger bar depressor 168 by itself are shown in FIG. 14 and FIG. 15. The trigger bar depressor 168 is slidably engaged with the pistol base frame 107 via trigger bar depressor grooves 174 shown in FIG. 12 and FIG. 16 that are angled in a rear end 176 of the pistol base frame 107. FIG. 13 shows an image of the trigger bar depressor 168 partially inserted in the trigger bar depressor grooves 174. Because of its dual sided design, the trigger bar depressor 168 can be removed, rotated 180 degrees, and reinserted into the trigger bar depressor grooves 174 to alter the trigger action of the pistol 100 such that the rear upper edge 166 of the primary arm 122 slides against and underneath the second depressor extension 172. Because the first depressor extension 170 is oriented at a different angle than the second depressor extension 172, the trigger action varies depending on which side of the trigger bar depressor 168 is in contact with the rear upper edge 166 of the primary arm 122.

Figure 16:
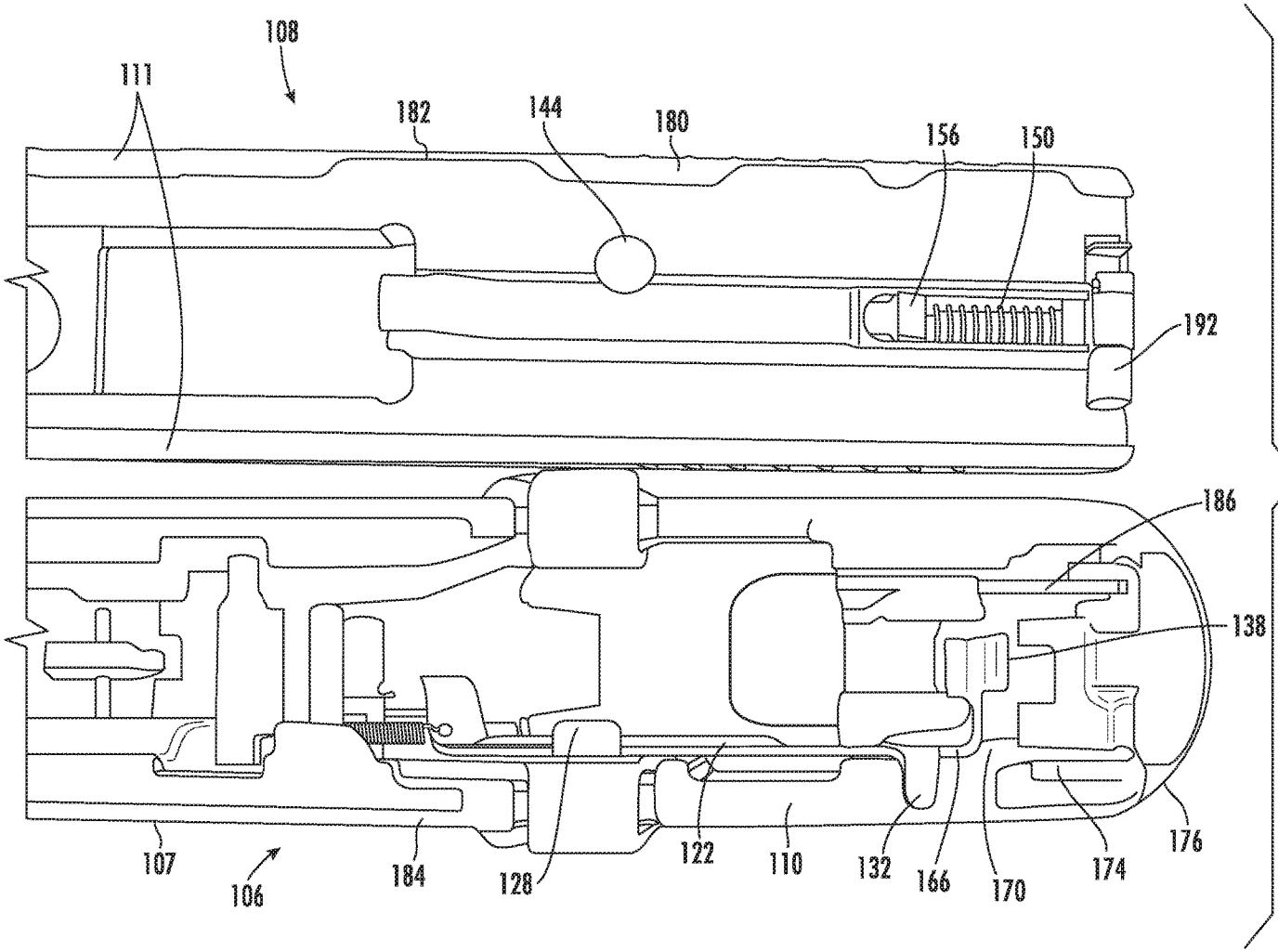
FIG. 16 shows an image of the pistol base from FIGS. 8, 10, 12 and 13 alongside a pistol slide wherein the internal parts of the pistol base and the pistol slide can be seen including a first slide ridge along an interior first side of the pistol slide wherein the slide ridge contacts the trigger bar as the pistol slide moves back in place after recoiling from a gunshot and wherein such contact moves the trigger bar inward and upward to reengage the trigger bar with the striker.
Figure 17:
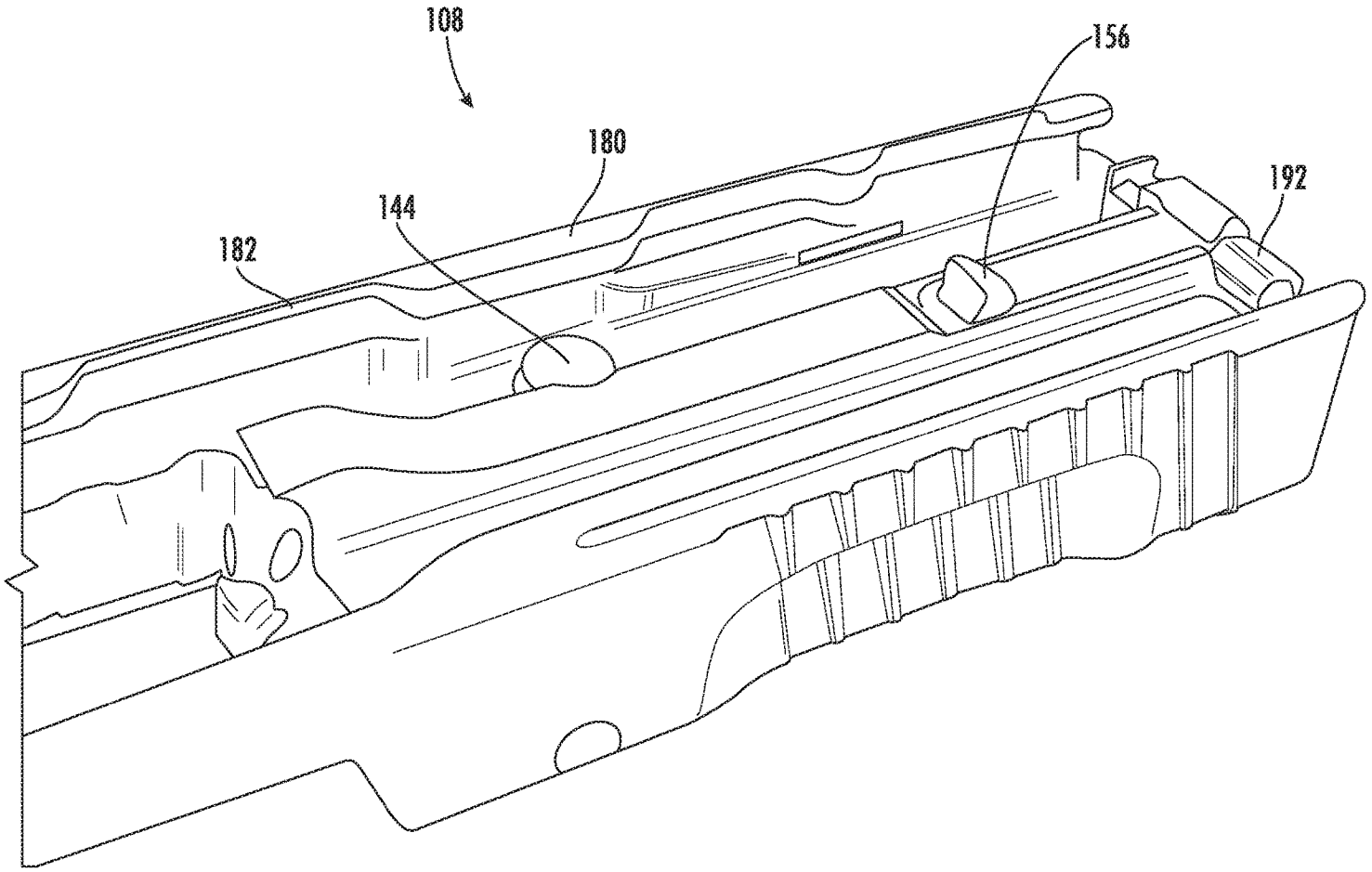
FIG. 17 shows an image of a perspective view of a rear portion of the pistol slide shown in FIG. 16.
Figure 18:
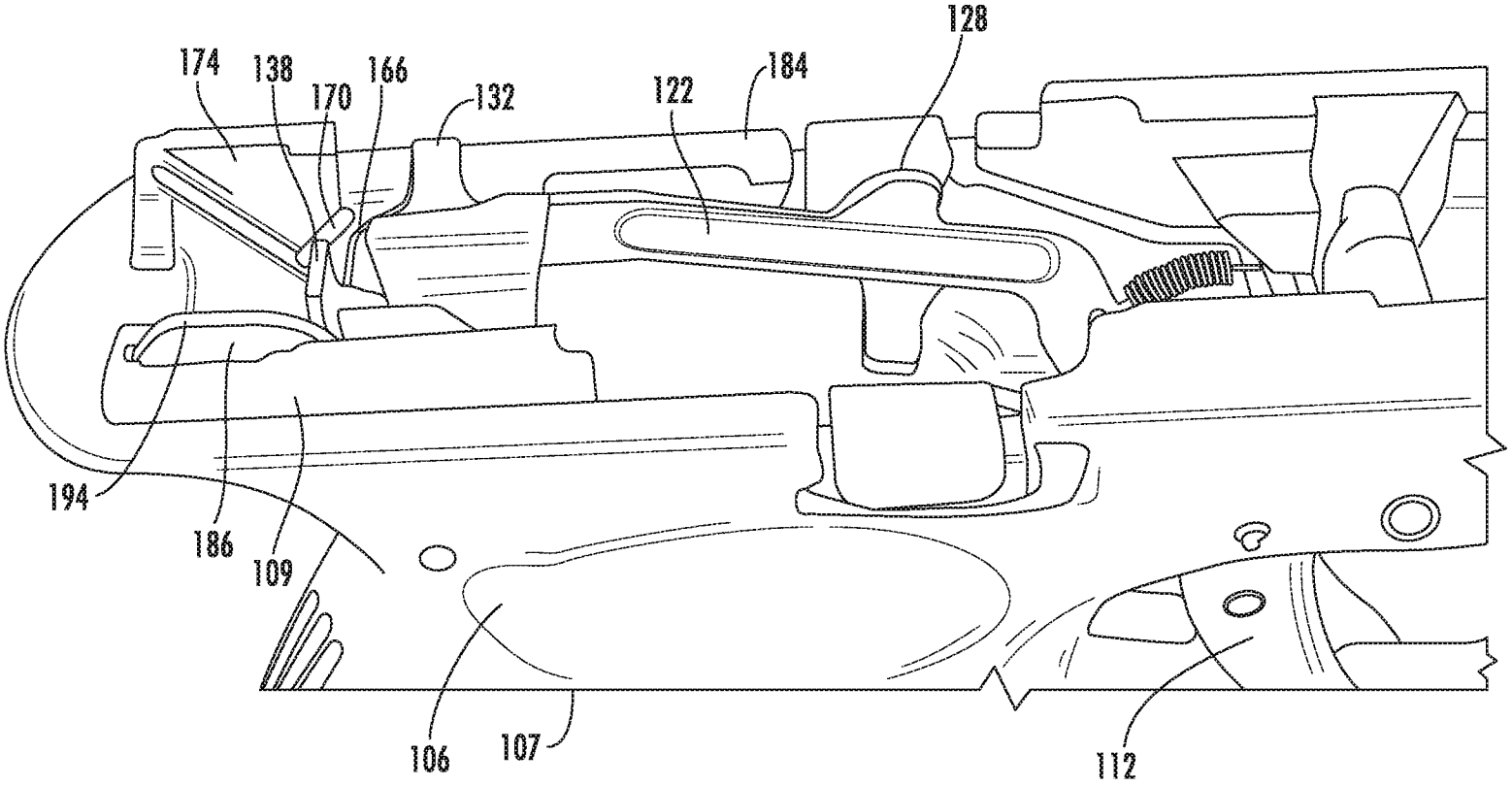
FIG. 18 shows an image of a side perspective view of a portion of the pistol base shown in FIG. 16.
Figure 19:
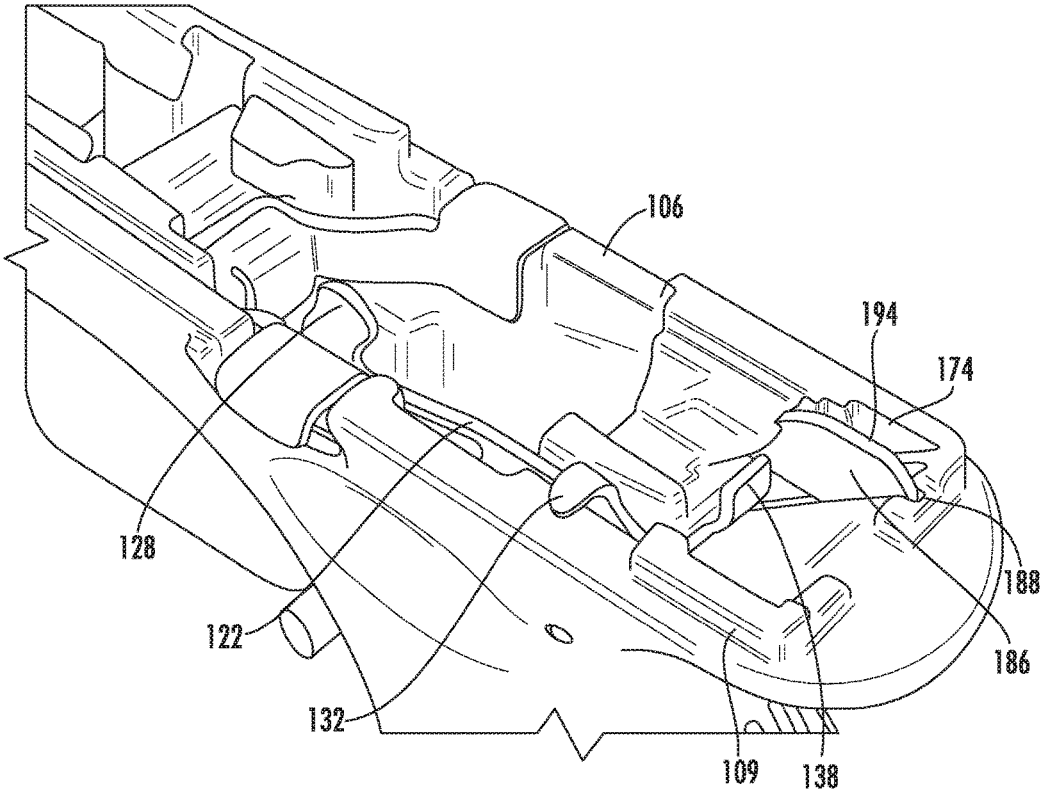
FIG. 19 shows an image of a perspective view of the rear end of the pistol base shown in FIG. 16 and FIG. 18.
Figure 20:
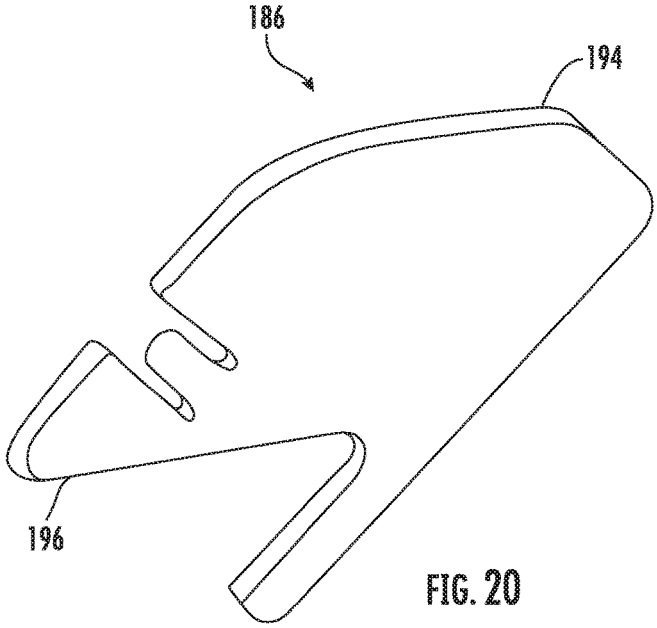
FIG. 20 shows an image of a trigger bar release member that fits inside a release member groove inside the pistol base from FIG. 19.
Figure 21:
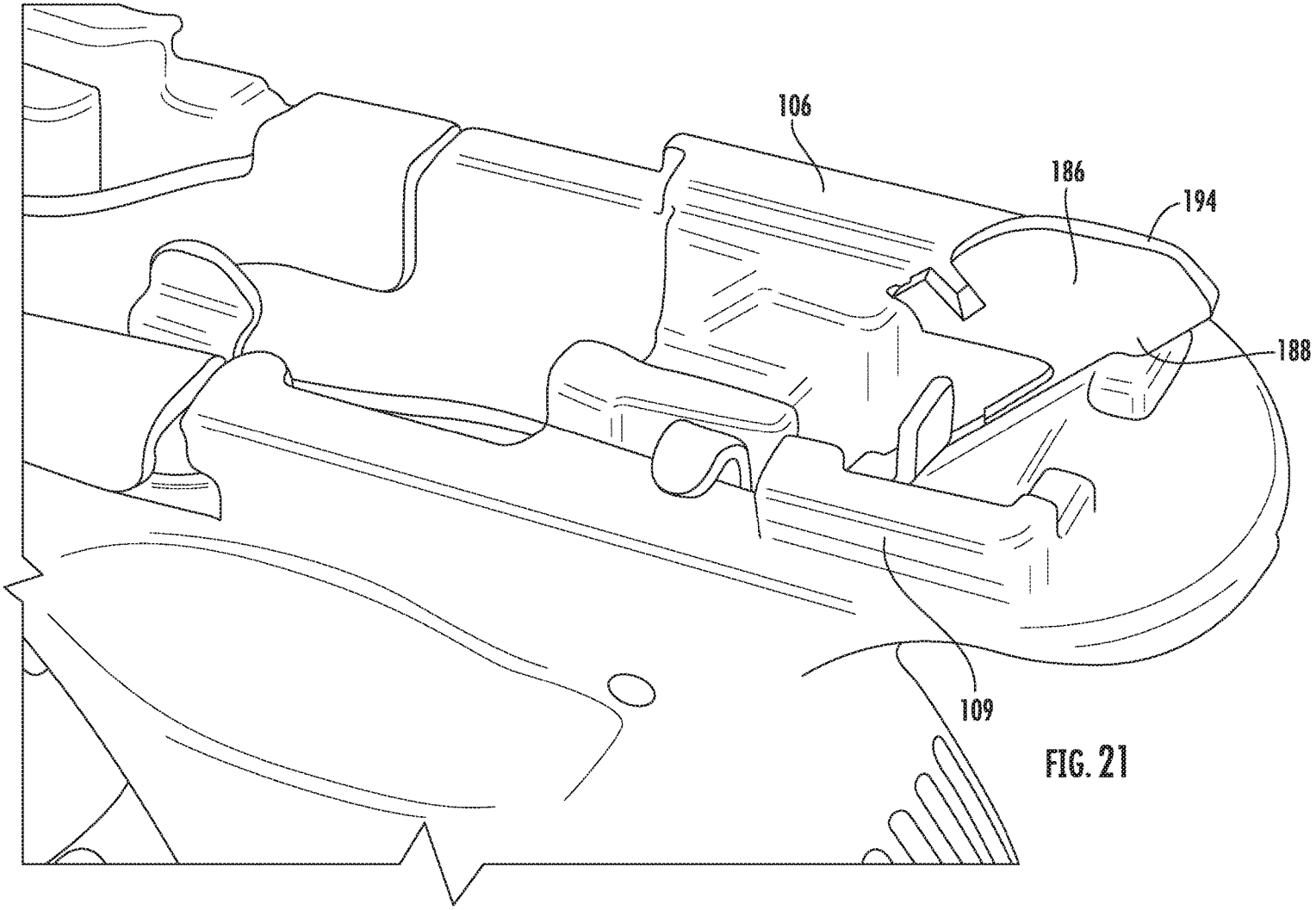
FIG. 21 shows an image including the trigger bar release member partially inserted in the release member groove inside the pistol base from FIG. 19.
Figure 22:
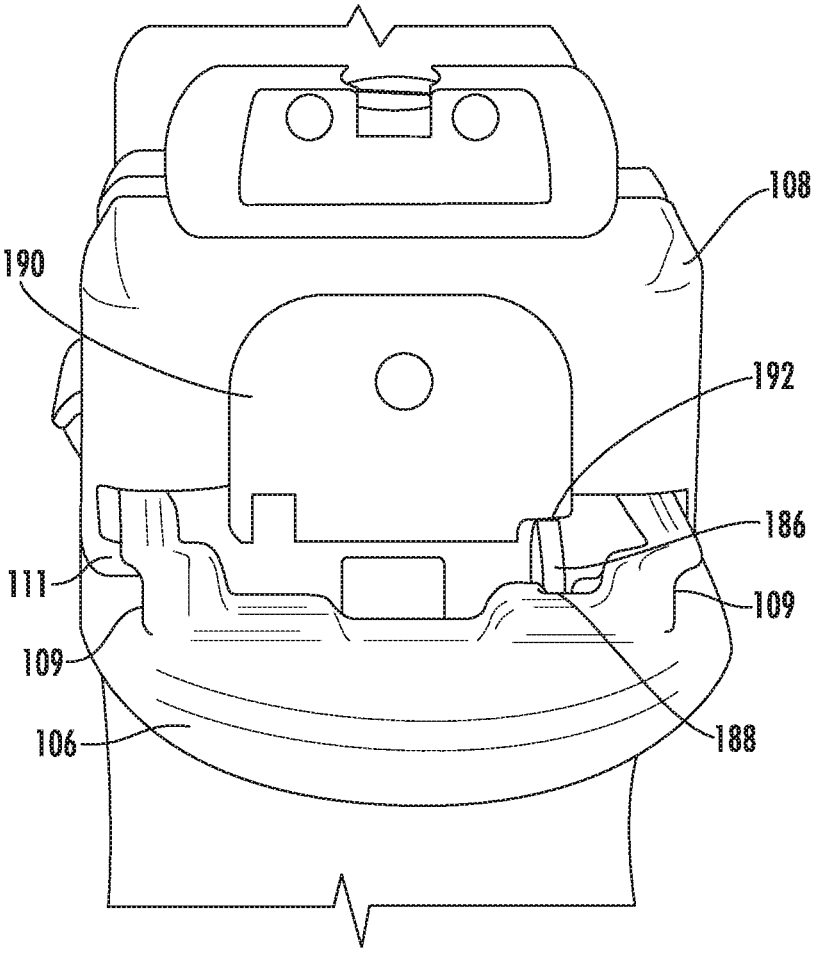
FIG. 22 shows an end view of the pistol base and pistol slide from FIG. 16 while the two components are attached and wherein the pistol slide is being urged forward relative to the pistol base to engage the pistol slide with the trigger bar release remember to fully disengage the pistol slide from the pistol base.
Figure 23:
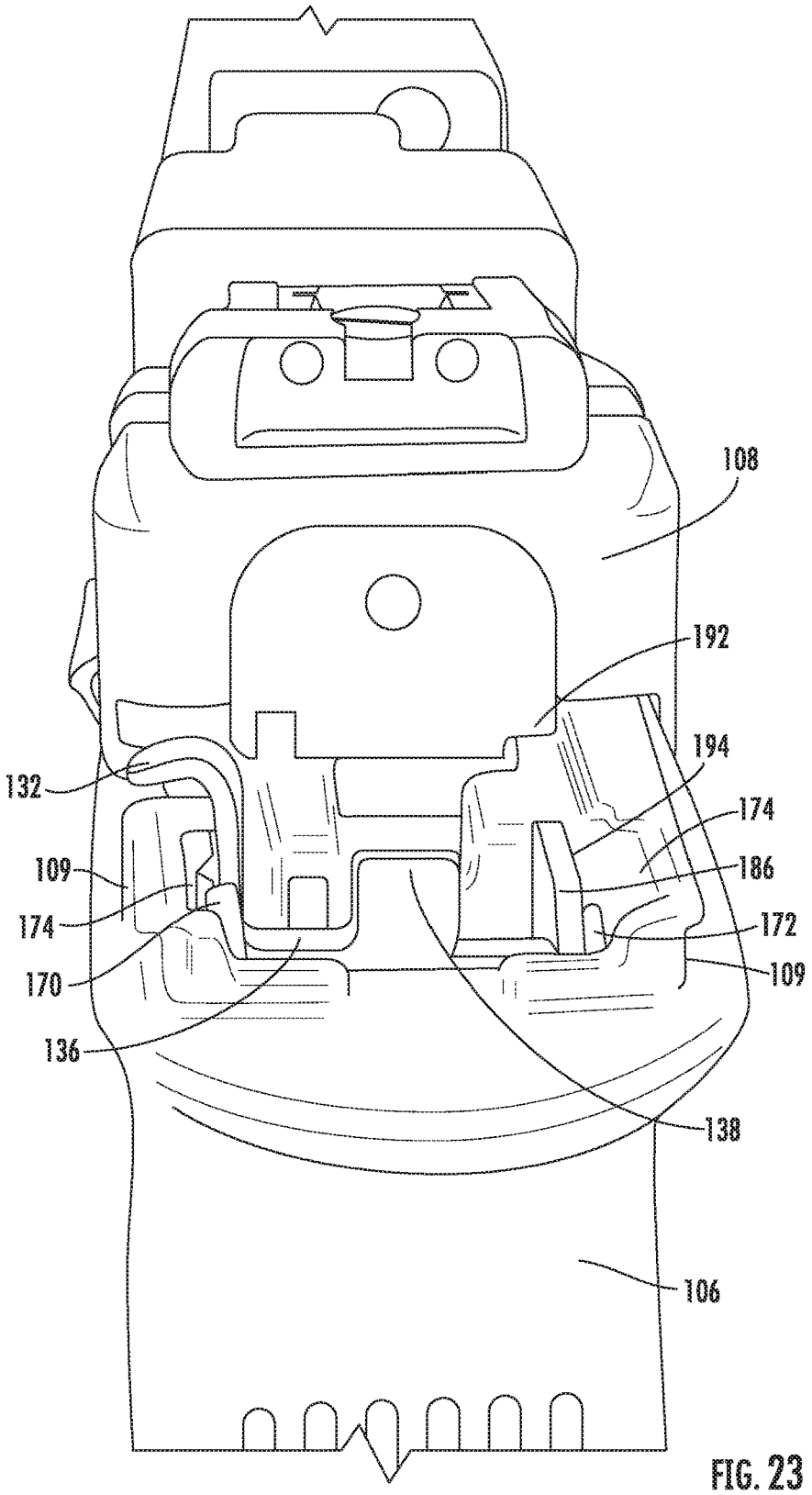
FIG. 23 shows another end view of the pistol base and pistol slide wherein the pistol slide has already moved past the trigger bar release member and the pistol slide is free to be fully disengaged from the pistol base without the need of pulling the trigger of the pistol.

After the striker 142 contacts a cartridge primer during firing action of the pistol 100, the pistol slide 108 recoils and is forced rearward so that part of the pistol slide 108 extends beyond the rear end 176 of the pistol base frame 107, thereby drawing the striker extension 156 back behind the third trigger bar extension 136. However, the trigger bar 102 is still in a fully depressed state held down by the trigger bar depressor 168 as shown in FIG. 9 during recoil of the pistol slide 108. The pistol slide 108 is forced back forward over the pistol base 106 by a slide plunger assembly 178 shown in FIG. 1. As the pistol slide 108 moves back from its recoiled position, the second trigger bar extension 132 comes into contact with a first slide ridge 180 along an interior first side 182 of the slide 108. Contact with the first slide ridge 180 forces the second trigger bar extension 132 inward and upward, thereby forcing the entire trigger bar 102 upward to reset the first sub-extension 138 against the striker extension 156 as shown in FIG. 6. FIG. 16 shows the pistol base 106 and pistol slide 108 detached and open showing parts that physically interact with each other including the second trigger bar extension 132 along a first side 184 of the pistol base 106 and the first slide ridge 180 along the interior first side 182 of the slide 108. FIG. 17 shows a perspective view of a portion of the slide 108 including the first slide ridge 180.

Another important aspect of the pistol 100 described herein is the inclusion of a trigger bar release member 186 as shown in FIGS. 6, 11, and 18-23. The trigger bar release member 186 is shown by itself in FIG. 20 in substantially the same orientation in which it is inserted in a release member groove 188 in the pistol 100 when the pistol 100 is held upright and level. The release member 186 is shown partially inserted in the release member groove 188 of the pistol base 106 in FIG. 21. The release member 186 allows a user to disengage the first sub-extension 138 of the trigger bar 102 from the striker extension 156 and remove the pistol slide 108 from the pistol base 106 without the need to pull the trigger 112. The way the release member 186 works is a user holds the pistol base 106 and pushes forward on a rear end 190 of the pistol slide 108. As the pistol slide 108 moves forward relative to the pistol base 106, a second slide ridge 192 moves over and presses down on an upper edge 194 of the release member 186. As the release member 186 is pushed away from the pistol slide 108, a lower edge 196 of the release member 186 then presses down on the second sub-extension 140 of the third trigger bar extension 136 (as shown from above in FIG. 11), thereby forcing the entire trigger bar 102 to a depressed position as shown, for example, in FIG. 9. Because the trigger bar 102 is lowered in a depressed position, the first sub-extension 138 is moved away from the striker extension 156, freeing the striker 142 to move forward relative to the pistol base 106 past the first sub-extension 138, thereby freeing the pistol slide 108 from the pistol base 106. The release member 186 is preferably biased upward by a spring or other biasing means so that the release member returns to its original position after the second slide ridge 192 has passed over the release member 186.

Figure 24:
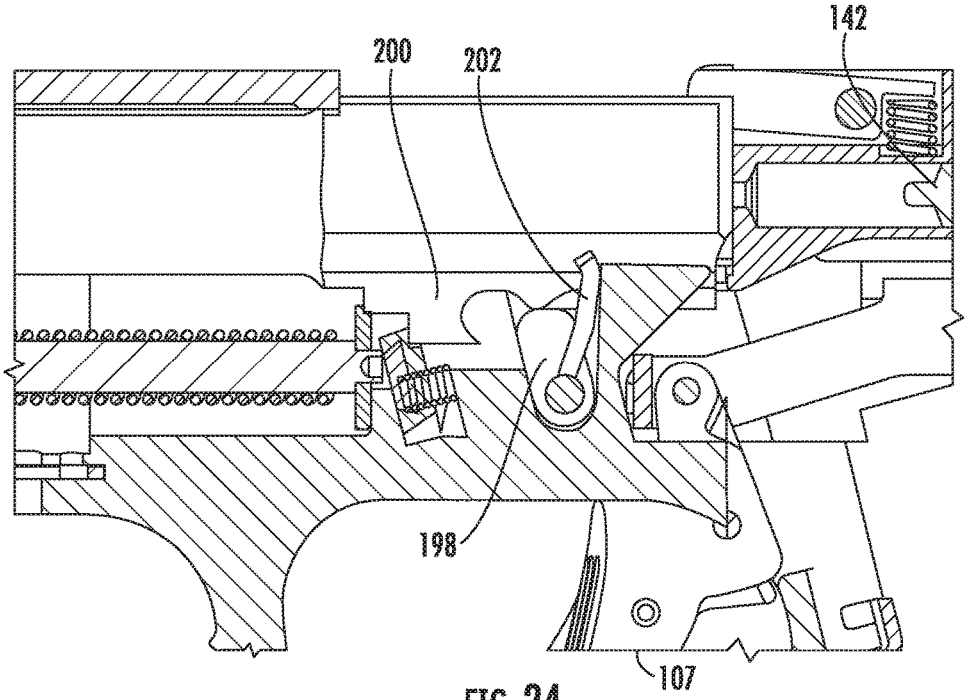
FIG. 24 shows a partial cross-sectional view of the pistol from FIG. 1 showing a locking block and locking block springs in a resting position before a shot is fired.
Figure 25:
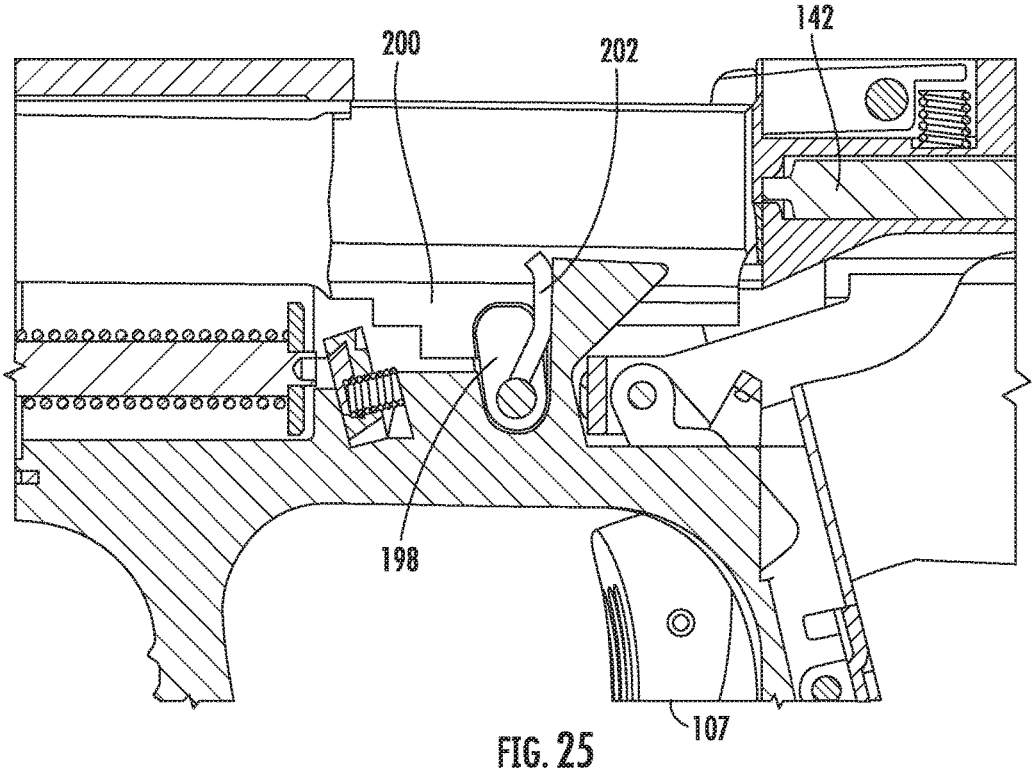
FIG. 25 shows a partial cross-sectional view of the pistol from FIG. 1 and FIG. 24 showing a locking block and locking block springs after a shot is fired wherein the barrel of the pistol is unlocked from the slide and stopped.
Figure 26:
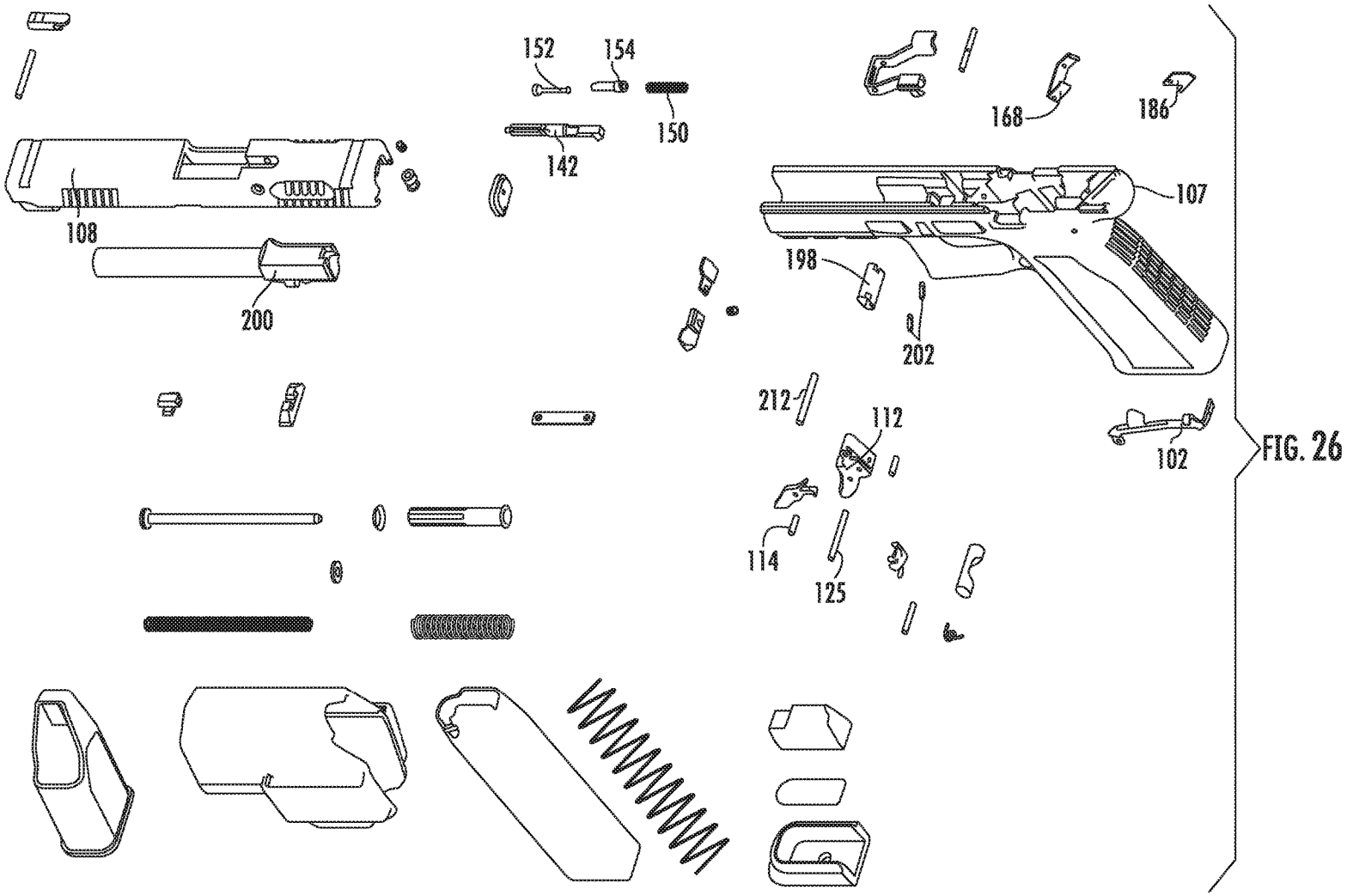
FIG. 26 shows an exploded view including the various parts of the pistol from all of the previous figures.

Another novel aspect of the disclosure is the use of springs in a locking block. Virtually all pistols have a locking and unlocking block, pins or other similar devices that help to lock and unlock the barrel from the pistol slide. No such devices include springs connected to the locking block, however. The lighter a pistol is, the harder the recoil to the hand of a user. Making a pistol heavier helps address this problem, but it is often advantageous to have a lighter pistol for other reasons. As such, what is needed is a novel way to minimize the recoil of a pistol—particularly for light pistols. FIG. 24 shows a side cross-sectional view of the pistol from FIG. 1 including a locking block 198. The view in FIG. 24 is of the pistol wherein the locking block 198 is in a resting position before a shot is fired. FIG. 25 shows the same view as FIG. 24 but after a shot is fired wherein the barrel 200 has been unlocked from the slide 108 and has been stopped. With reference to FIGS. 24-26, there are two flat springs 202 used to cushion the locking block 198 when firing the pistol 100 as the locking block 198 is forced back against the pistol base frame 107. FIG. 26 shows an exploded view of the pistol 100 with various parts shown including the locking block 198, the locking block springs 202 and other features previously discussed herein. Although two springs are used in the embodiment shown in the figures, use of one spring or more than two springs is considered an alternative option for other embodiments of the invention.

Figure 27:
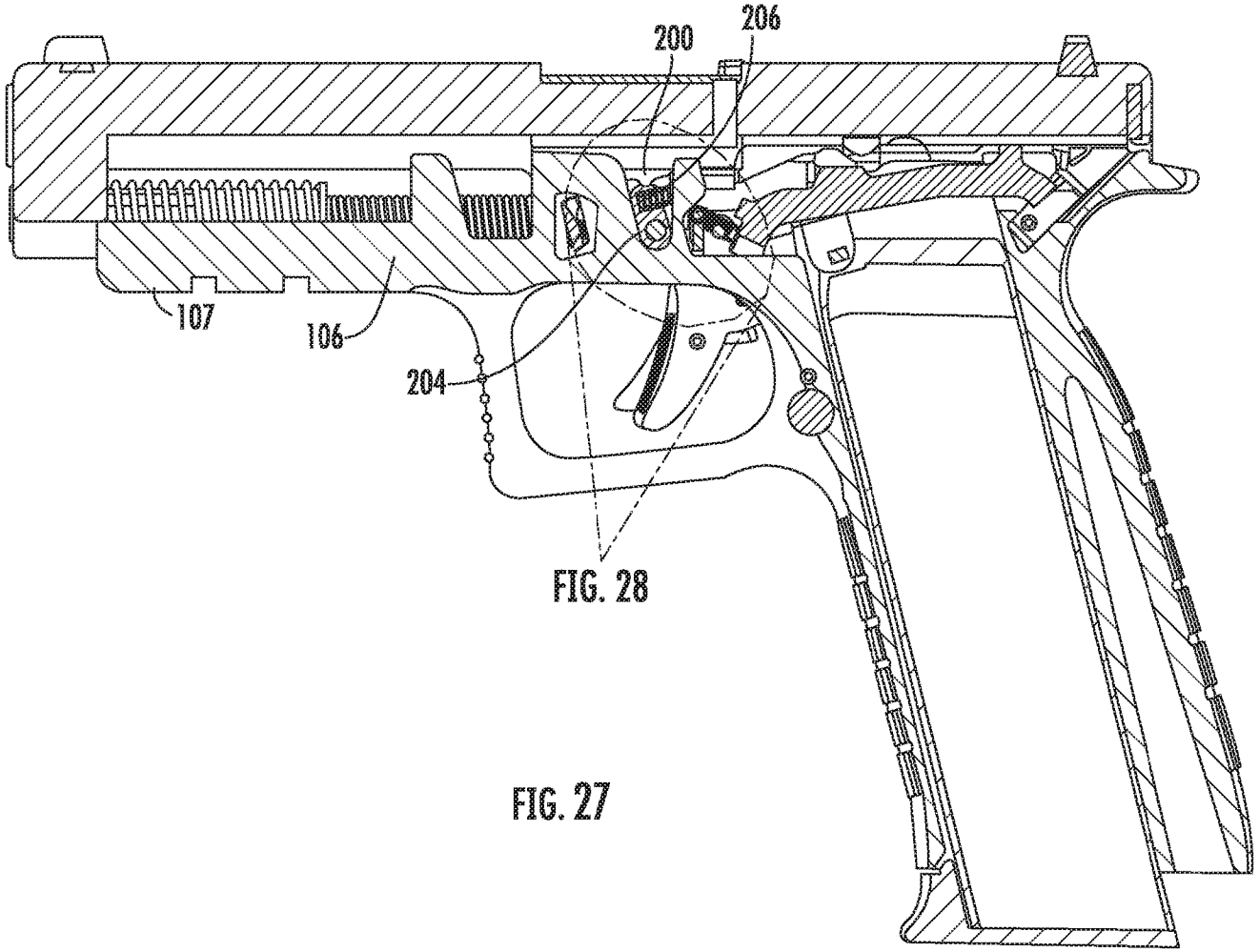
FIG. 27 shows a cutaway side view of a pistol as described herein including a locking block which includes coil springs partly separating the locking block from an interior surface of the pistol base frame.
Figure 28:
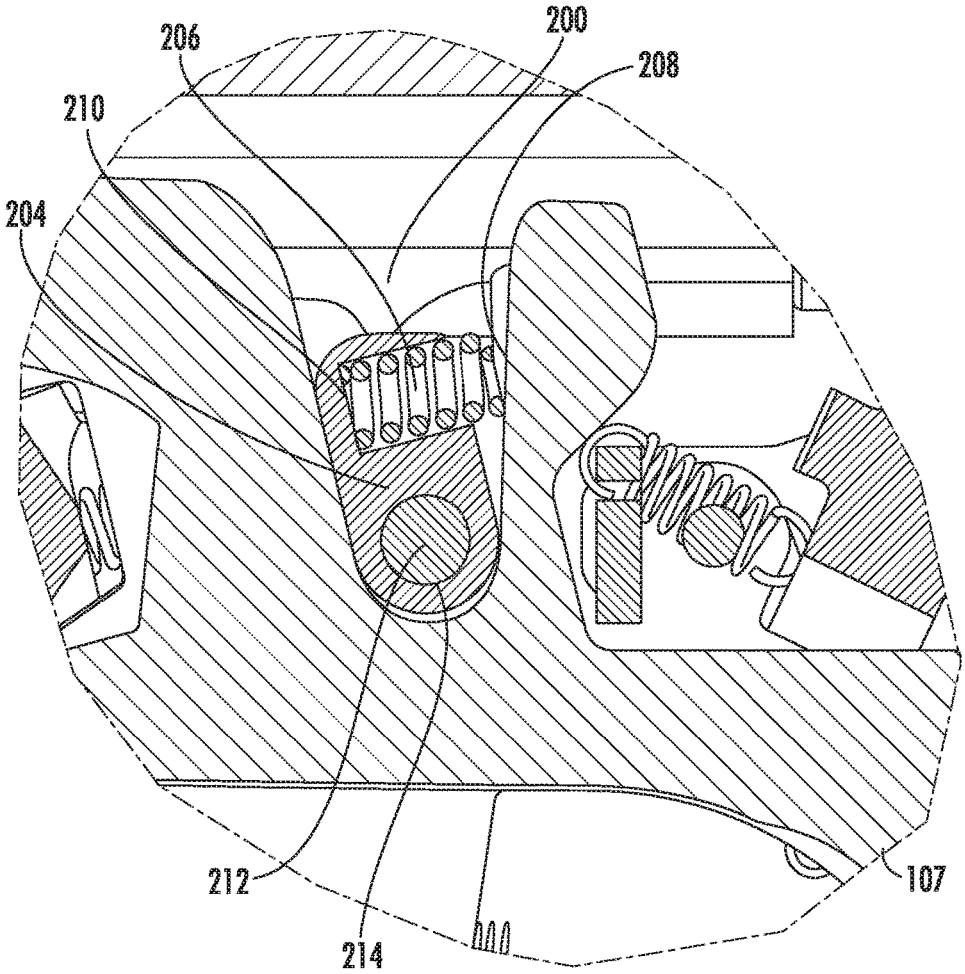
FIG. 28 shows a closeup cutaway view of the pistol from FIG. 27 wherein the closeup shows the locking block and locking block springs.
Figure 29:
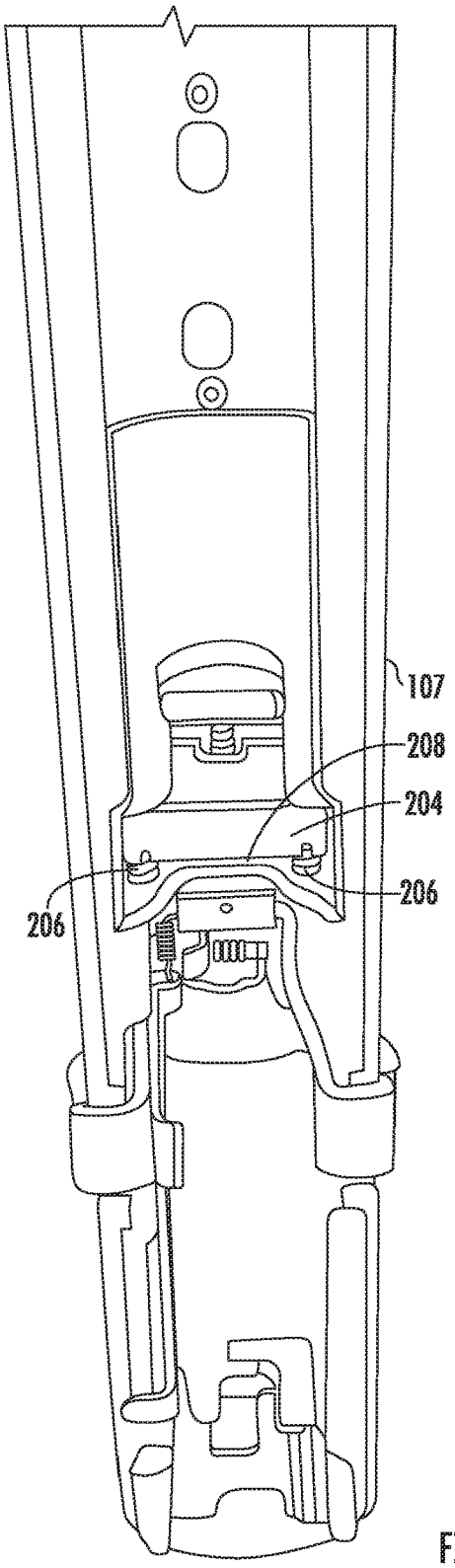
FIG. 29 shows a view into the pistol base of the pistol shown in FIG. 27 and FIG. 28, wherein such view shows a pair of lock block springs extending out away from an interior surface of the pistol base frame and into the locking block.

Different types of springs can be used as well other than the flat springs 202 show in FIGS. 24-26. For example, FIG. 27 shows a cutaway side view of the pistol base 106 of the pistol 100 with a slightly different locking block 204 and locking block springs 206 which are in the form of coil springs. The pair of coil springs 206 extend out from an interior surface 208 of the pistol base frame 107 and into recesses 210 of the locking block 204. The springs 206 cushion the force of the locking block 204 as it is forced back by the barrel 200 during firing of the pistol 100 (wherein such action is shown for example in the previous embodiment shown in FIGS. 24 and 25). FIG. 28 shows a closeup cutaway side view of the pistol 100 with the locking block 204 and locking block springs 206. The locking block 204 rotates along a locking block rod 212 that extends through a locking block aperture 214 extending internally through the locking block 204. FIG. 29 shows a view looking into the pistol base 106 with the pistol slide 108 removed showing the pair of springs 206 extending away from the interior surface 208 of the pistol base frame 107 into the locking block 204 and the plurality of recesses 210. Distal ends 216 of the springs contact the interior surface 208 of the pistol base frame 107. There are numerous advantages to the embodiments described herein. One advantage is a trigger bar 102 made of a single piece of material (preferably metal) that performs multiple tasks including (1) retaining the striker 142, (2) cocking the striker 142, (3) releasing the striker 142, (4) blocking or releasing the striker safety extension 144, (5) and disconnecting itself from the trigger bar depressor 168 via the second trigger bar extension 132. No other known trigger bar performs all of these functions as a single piece of material.

Another important advantage to the embodiments described herein include a trigger bar release mechanism including the trigger bar release member 186 that allows a user to fully disengage the pistol slide 108 from the pistol base 106 without having to pull the trigger to release the striker 142 from a retaining mechanism (e.g., with the particular pistol described herein, the first sub-extension 138 along the trigger bar 102). Striker fired pistols notoriously require a user to pull the trigger to release a pistol slide cover from a pistol base during disassembly, which is very dangerous because, if a cartridge is in the barrel chamber, a pistol can be unintentionally fired when trying to remove a pistol slide cover from a pistol base. Many unintended gunshot wounds have occurred due to this problem. The trigger bar release mechanism described herein avoids this problem.

Yet another advantage is the use of a dual-sided trigger bar depressor 168 that can be removed and rotated 180 degrees and put back in place in the trigger bar depressor grooves 174 to alter the trigger pull weight of the pistol 100. The first depressor extension 170 is angled differently than the second depressor extension 172, therefore, the particular depressor extension in contact with the rear upper edge 166 of the primary arm 122 at any given time determines how heavy or light the trigger 112 feels when depressing the trigger 112. So, one component (i.e., the trigger bar depressor 168) effectively has two different settings.

Another advantage described herein is the use of one or more locking block springs (202 or 206) to cushion the effect of the recoil of the barrel 200 when the pistol 100 is fired and the barrel 200 is forced against the locking block (198 or 204).

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A pistol comprising:

a. a pistol base comprising:

i. a base frame;

ii. a trigger connected to the base frame;

iii. a trigger bar connected to the trigger proximate to a first end of the trigger bar, the trigger bar further comprising:

1. a primary arm that extends from the first end of the trigger bar to a second end of the trigger bar;

2. a first trigger bar extension extending out from a first side of the primary arm;

3. a second trigger bar extension extending out from a second side of the primary arm; and 4. a third trigger bar extension extending out from the first side of the trigger arm and further comprising a first sub-extension extending upward toward a pistol slide; and iv. a trigger bar depressor inserted in the base frame, the trigger bar depressor comprising a first depressor extension wherein an upper edge of the trigger bar contacts and slides partially underneath the first depressor extension when the trigger is pulled wherein the contact with the first depressor extension forces the trigger bar away from the pistol slide to place the trigger bar in a depressed state;

b. the pistol slide physically engaged with the pistol base wherein the pistol slide slides relative to the pistol base during firing of the pistol, the pistol slide comprising:

i. a striker comprising 1. a striker plunger assembly including a spring for biasing the striker in a first direction relative to the pistol base; and 2. a striker extension extending downward and in direct contact with the first sub-extension of the trigger bar wherein the first sub-extension of the trigger bar retains the striker until the trigger is pulled by a user at which point the trigger bar moves to the depressed state, the striker extension is released from the first sub-extension of the trigger bar and the striker is propelled in the first direction by the striker plunger assembly;

ii. a striker safety extension extending toward the pistol base from the pistol slide and physically engaging with the striker to prevent the striker from moving in the first direction wherein the striker safety extension is contacted by the first trigger bar extension when the trigger is pulled wherein such contact moves the striker safety extension, disengaging the striker safety extension from the striker and thereby allowing the striker to be propelled in the first direction by the striker plunger assembly; and iii. a first slide ridge located along an interior surface of the pistol slide along a first side of the pistol slide wherein the first slide ridge contacts the second trigger bar extension when the pistol slide moves forward relative to the pistol base after the pistol slide has recoiled after the pistol has been fired wherein such contact between the first slide ridge and second trigger bar extension forces the trigger bar up out of the depressed state to reengage the first sub-extension with the striker extension.

2. The pistol of claim 1 further comprising:

a. a trigger bar release member groove in the pistol base proximate to a rear end of the pistol base;

b. a trigger bar release member inserted into the trigger bar release member groove;

c. the pistol slide further comprising a second slide ridge proximate to a rear end of the pistol slide oriented so that the second slide ridge presses down on an upper edge of the trigger bar release member when the pistol slide is pushed forward relative to the pistol base;

d. the third trigger bar extension further comprising a second sub-extension that is forced away from the pistol slide as the second sub-extension is contacted by a lower edge of the trigger bar release member when the pistol slide is slid forward relative to the pistol base, thereby forcing the trigger bar into the depressed state and freeing the striker extension from the first sub-extension so that the pistol slide can be completely disengaged from the pistol base without pulling the trigger.

3. The pistol of claim 1 further comprising:

a. the trigger bar depressor further comprising:

i. a trigger bar depressor base;

ii. a first trigger bar depressor arm; and iii. a second trigger bar depressor arm wherein the first trigger bar depressor arm and the second trigger bar depressor arm extend from the trigger bar depressor base in a substantially symmetrical configuration, wherein the first trigger bar depressor arm includes the first depressor extension oriented at a first angle, and wherein the second trigger bar depressor arm includes a second depressor extension oriented at a second angle; and b. a plurality of trigger bar depressor grooves in the base frame in which the trigger bar depressor is housed and is held substantially stationary relative to the base frame, wherein the trigger bar depressor can be inserted into the plurality of trigger bar depressor grooves in two different configurations including a first configuration in which the upper edge of the trigger bar contacts and slides partially underneath the first depressor extension when the trigger is pulled resulting in a first trigger pull weight and a second configuration in which the upper edge of the trigger bar contacts and slides partially underneath the second depressor extension when the trigger is pulled resulting in a second trigger pull weight.

4. A pistol comprising: a. a pistol base comprising:

a base frame;

ii. a trigger connected to the base frame;

iii. a trigger bar connected to the trigger proximate to a first end of the trigger bar, the trigger bar further comprising:

1. a primary arm that extends from the first end of the trigger bar to a second end of the trigger bar; and 2. a trigger bar extension extending out from a first side of the trigger arm and further comprising;

a. a first sub-extension extending upward toward a pistol slide; and b. a second sub-extension extending out beneath a trigger bar release member;

iv. a trigger bar release member groove in the pistol base proximate to a rear end of the pistol base; and v. the trigger bar release member inserted into the trigger bar release member groove; and b. a pistol slide physically engaged with the pistol base wherein the pistol slide slides relative to the pistol base during firing of the pistol, the pistol slide comprising:

i. a striker comprising:

1. a striker plunger assembly including a spring for biasing the striker in a first direction relative to the pistol base; and 2. a striker extension extending downward and in direct contact with the first sub-extension of the trigger bar wherein the first subextension of the trigger bar retains the striker until the trigger is pulled by a user at which point the trigger bar moves to a depressed state, the striker extension is released from the first sub-extension of the trigger bar and the striker is propelled in the first direction by the striker plunger assembly; and ii. a second slide ridge proximate to a rear end of the pistol slide oriented so that the second slide ridge presses down on an upper edge of the trigger bar release member when the pistol slide is pushed forward relative to the pistol base and wherein the second subextension is forced away from the pistol slide as the second subextension is contacted by a lower edge of the trigger bar release member when the pistol slide is pushed forward relative to the pistol base, thereby forcing the trigger bar into the depressed state and freeing the striker extension from the first sub-extension so that the pistol slide can be completely disengaged from the pistol base without pulling the trigger.

* * * * *